US012385187B2

(12) United States Patent
Young et al.

(10) Patent No.: US 12,385,187 B2
(45) **Date of Patent: *Aug. 12, 2025**

(54) FAST-WETTING COFORM FIBROUS STRUCTURES

(71) Applicant: The Procter & Gamble Company, Cincinnati, OH (US)

(72) Inventors: Christopher Michael Young, Loveland, OH (US); Steven Lee Barnholtz, West Chester, OH (US); Todd Leon Mansfield, Cincinnati, OH (US); Michael Gomer Stelljes, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/871,462

(22) Filed: Jul. 22, 2022

(65) Prior Publication Data

US 2022/0364308 A1 Nov. 17, 2022

Related U.S. Application Data

(63) Continuation of application No. 16/944,201, filed on Jul. 31, 2020, now Pat. No. 11,408,126.
(Continued)

(51) Int. Cl.
*D21H 21/22* (2006.01)
*D21H 17/33* (2006.01)
(Continued)

(52) U.S. Cl.
CPC ..... *D21H 21/22* (2013.01); *D21H 17/33* (2013.01); *D21H 21/50* (2013.01); *D21H 27/002* (2013.01); *D21H 27/38* (2013.01)

(58) Field of Classification Search
CPC ..... D21H 21/22; D21H 17/33; D21H 21/50; D21H 27/002; D21H 27/38
(Continued)

(56) References Cited

U.S. PATENT DOCUMENTS 3,105,491 A * 10/1963 Harwood ..... D21H 5/12 604/377
11,408,126 B2 8/2022 Young et al.
(Continued)

FOREIGN PATENT DOCUMENTS

WO WO-9955267 A1 * 11/1999 ..... A61F 13/15203

OTHER PUBLICATIONS

All Office Actions; U.S. Appl. No. 16/944,201, filed Jul. 31, 2020.

*Primary Examiner* — Abbas Rashid
*Assistant Examiner* — Stephen M Russell
(74) *Attorney, Agent, or Firm* — James E. Oehlenschlager

(57) ABSTRACT

Fast-wetting (hydrophilic) coform fibrous structures, more particularly fast-wetting composite fibrous structures, for example dry fast-wetting composite fibrous structures, employing a wet-laid fibrous structure such as a paper web, and a coform fibrous structure, multi-ply fibrous structures, for example multi-ply sanitary tissue products such as multi-ply absorbent products for example multi-ply paper towel products, employing one or more fast-wetting composite fibrous structures, and methods for making same.

18 Claims, 16 Drawing Sheets

Related U.S. Application Data

(60) Provisional application No. 62/887,170, filed on Aug. 15, 2019.

(51) Int. Cl.
*D21H 21/50* (2006.01)
*D21H 27/00* (2006.01)
*D21H 27/38* (2006.01)

(58) Field of Classification Search
USPC ..... 162/127
See application file for complete search history.

(56) References Cited

U.S. PATENT DOCUMENTS

| | | | | |
|---|---|---|---|---|
| 2007/0207293 | A1 | 9/2007 | Santiago | |
| 2015/0147568 | A1 | 5/2015 | Barrera et al. | |
| 2015/0374561 | A1* | 12/2015 | Hubbard, Jr. | C08F 2/32 604/369 |
| 2016/0130799 | A1* | 5/2016 | Topolkaraev | C08J 5/18 252/62 |
| 2017/0224544 | A1 | 8/2017 | Decker et al. | |
| 2018/0209101 | A1* | 7/2018 | Cabell | D21F 11/16 |

* cited by examiner

Wetlaid Unwind
Inside Ply
24
70
22
Unwind
Outside ply
22
Thermal
Plybond
24
88
90
74
76
72
High Definition
Emboss
Perforations
28
96
98
100
102
102
28
104
Finished Product
Winding
28

28
106
94
24
94
22
88
90
76
74
24
72
22

FAST-WETTING COFORM FIBROUS STRUCTURES

FIELD OF THE INVENTION

The present invention relates to fast-wetting (hydrophilic) coform fibrous structures, more particularly fast-wetting composite fibrous structures, for example dry fast-wetting composite fibrous structures, comprising a wet-laid fibrous structure such as a paper web, and a coform fibrous structure, multi-ply fibrous structures, for example multi-ply sanitary tissue products such as multi-ply absorbent products for example multi-ply paper towel products, comprising one or more fast-wetting composite fibrous structures, and methods for making same.

BACKGROUND OF THE INVENTION

The ability of absorbent products, for example sanitary tissue products such as paper towels to absorb water is a critical feature for consumers of absorbent products, especially paper towels. In order for absorbent products to perform their absorption function the absorbent articles need to be able to be wetted or in other words, the absorbent products need to exhibit hydrophilicity to attract and/or absorb water rather than repel water. Wood pulp fiber-based fibrous structures such as paper webs typically absorb water readily unlike coform-based fibrous structures, which contain thermoplastic filaments, such as polyolefin filaments like isotactic polypropylene, which do not due to their hydrophobic nature of the thermoplastic filaments. However, formulators desire to use coform fibrous structures to make absorbent products that better meet consumers' needs. Therefore, the need to address the hydrophobic nature of known coform fibrous structures becomes paramount.

Formulators have made various attempts to make coform fibrous structures less hydrophobic and even hydrophilic. One attempt at doing so includes surface treating coform fibrous structures with a surface hydrophilic modifier to aid in the attraction and/or absorption of water by such coform fibrous structures. However, surface hydrophilic modifiers easily wash off after minimal, such as one insult of water to the coform fibrous structure, thus even though the surface hydrophilic modifier-treated coform fibrous structure may exhibit immediate hydrophilicity that hydrophilicity is short-lived and/or temporary and/or non-durable.

Another attempt by formulators is to include hydrophilic modifiers into the polymer melt composition from which the fibrous elements, for example thermoplastic filaments such as polypropylene filaments (isotactic polypropylene filaments), are made that ultimately create the filaments of the coform fibrous structure. Such inclusion in the polymer melt compositions of the thermoplastic filaments helps address the durability of the hydrophilicity but continues to exhibit its own issues. For example, coform fibrous structures and thus absorbent products, such as paper towels, made from such known coform fibrous structure containing such thermoplastic filaments do not immediately exhibit hydrophilicity because the hydrophilic modifier doesn't bloom to the surface of the filaments and thus the surface of the absorbent product (for example paper towel) in a consumer relevant timeframe, for example in less than 30 days and/or in less than 25 days and/or in less than 20 days and/or in less than 15 days and/or in less than 10 days and/or in less than 5 days and/or in less than 3 days without the need to subject the coform fibrous structures to conditions of elevated heat and humidity, which is impractical for commercial consumer products, as further discussed below.

Further, even if formulators were to surface treat such coform fibrous structures with hydrophilic modifiers and include hydrophilic modifiers in the polymer melt compositions that the filaments of such fibrous structures are made from it wouldn't solve the problem because the coform fibrous structures would lose their immediate hydrophilicity from the surface treated hydrophilic modifiers after the first insult of water and there would be an unacceptable gap in time (over a month or so, for example) before the hydrophilic modifiers within the filaments would bloom to the surface of the filaments to provide the durable hydrophilicity to the coform fibrous structures.

Durable hydrophilicity is a key objective in water-insoluble, thermoplastic filament (such as polypropylene) coform fibrous structures (nonwovens) used in absorbent articles. Durability is defined as the ability of a fibrous structure and/or article continuing the fibrous structure to remain hydrophilic (that is, to exhibit a Millipore water contact angle of less than 90 degrees) after multiple insults with water as measured according to the Contact Angle Test Method described herein. In addition to the durable hydrophilicity, such absorbent articles desirably exhibit the hydrophilicity immediately after being produced into the absorbent articles, for example within 30 days or less and/or 25 days or less and/or 20 days or less and/or 15 days or less and/or 10 days or less and/or 5 days or less and/or 3 days or less after production (spinning of the fibrous elements) as measured according to the Contact Angle Test Method described herein.

As discussed above, to provide coform fibrous structures with hydrophilicity, one or more hydrophilic modifiers (also referred to as wetting agents) may be added into the polymer melt composition before spinning of fibrous elements from the polymer melt composition and forming of the fibrous structure from the fibrous elements, for example filaments, and ultimately producing the absorbent article comprising such a fibrous structure, as opposed to less durable, topical application of hydrophilic modifiers.

As described above, previous attempts to make a durably hydrophilic absorbent article, for example a paper towel comprising a coform fibrous structure has required additional processing of the absorbent article after production (spinning of the fibrous elements) via exposure to elevated heat and humidity. This conditioning, which is impractical for commercial consumer products, is necessary in order to achieve sufficient blooming of hydrophilic modifiers from the interior of the thermoplastic filaments of the coform fibrous structures to the surfaces of the filaments to make the coform fibrous structures sufficiently wettable and thus suitable for use as an absorbent article, especially a paper towel. Without being bound by theory, it is believed that the elevated heat and humidity provides the necessary energy and driving force to allow the hydrophilic modifier, which is initially homogenously distributed in the cross section of the fibrous elements, for example polyolefin fibrous elements, to migrate through the polymer matrix (which is believed to be at least semi-crystalline or even crystalline as determined by any suitable method known in the art, for example DSC) to the surface of the fibrous element and thus the surface of the coform fibrous structure containing the fibrous elements and ultimately the surface of the absorbent article comprising such coform fibrous structure. Given enough time (at least 48 hours) at elevated heat (50° C. or greater) and relative humidity (60% or greater), an adequate amount of the hydrophilic modifier blooms to a surface of the fibrous element to result in the fibrous element's surface being converted from hydrophobic to hydrophilic (exhibits a Millipore water contact angle of less than 90 degrees).

The problem with known absorbent articles comprising known coform fibrous structures is that the absorbent articles do not exhibit immediate (less than 30 days and/or less than 25 days and/or less than 20 days and/or less than 15 days and/or less than 10 days and/or less than 5 days and/or less than 3 days after production (spinning of the fibrous elements)) hydrophilicity and durable hydrophilicity.

Accordingly, there is a need for absorbent articles comprising coform fibrous structures that exhibit immediate and durable hydrophilicity and methods for making same.

SUMMARY OF THE INVENTION

The present invention fulfills the need described above by providing absorbent articles comprising coform fibrous structures that exhibit immediate and durable hydrophilicity and methods for making same.

One solution to the problem identified above is to provide an absorbent article comprising a coform fibrous structure comprising fibrous elements, for example filaments, comprising a polymer comprising a polymer chain disrupter, for example a copolymer of propylene and α-olefin, for example ethylene, that disrupts the homogeneity, for example crystallinity of the polymer. One example of such a polymer chain disrupter is commercially available under the trade name Vistamaxx from ExxonMobil. In one example the chain disrupter is a random copolymer. In another example, the chain disrupter is a block copolymer. In one example, the chain disrupter is derived from propylene and α-olefin, for example a $C_2$-$C_{20}$ α-olefin and/or a $C_2$-$C_{12}$ α-olefin and/or a $C_2$-$C_8$ α-olefin. In one example the chain disrupter is a propylene-ethylene copolymer, for example an isotactic propylene-ethylene copolymer. The chain disrupter is an isomer, for example a polylactic acid-D isomer.

Vistamaxx is a well-known elastomer or elastomeric polymer that has been included in filaments of coform fibrous structures, but not scrim materials associated with the coform fibrous structures that result in the coform fibrous structures exhibiting elasticity and/or resiliency. However, it has unexpectedly been found that the inclusion of a hydrophilic modifier, for example a surfactant, and a polymer chain disrupter, such as Vistamaxx, into hydrophobic fibrous elements, such as thermoplastic filaments like polypropylene filaments, especially isotactic polypropylene filaments, for example in a scrim material associated with a coform fibrous structure, which ultimately forms a non-elastic composite fibrous structure (made up of a wet-laid fibrous structure and a coform fibrous structure with at least one scrim) and/or a non-elastic absorbent article, for example a non-elastic paper towel, provides the coform fibrous structure and thus the non-elastic composite fibrous structure and the non-elastic absorbent article, especially the non-elastic paper towel provides immediate and durable hydrophilicity thereto.

In one example, the at least one scrim material of the coform fibrous structure comprises a plurality of scrim fibrous elements, for example a scrim filament, such as a plurality of scrim filaments. At least one of the scrim fibrous elements may comprise a scrim polymer composition comprising a scrim polymer chain disrupter, for example a copolymer, such as a random copolymer and/or a block copolymer and/or a copolymer derived from propylene and an α-olefin, for example a $C_2$-$C_{20}$ α-olefin and/or a $C_2$-$C_{12}$ α-olefin and/or a $C_2$-$C_8$ α-olefin. In one example the copolymer is a propylene-ethylene copolymer, such as an isotactic propylene-ethylene copolymer.

The scrim polymer composition may further comprise a scrim hydrophilic modifier, for example a surfactant. The hydrophilic modifier may be present in the scrim polymer composition at a level of greater than 0% to less than 20% and/or greater than 0% to less than 15% and/or greater than 0.1% to less than 10% and/or greater than 0.1% to about 5% and/or about 0.5% to about 3% by weight of the scrim polymer composition.

In one example, the at least one scrim material, when present, is substantially void of scrim solid additives.

Recently, it has been discovered that adding small amounts of a polymer chain disrupter to the polymer matrix of the fibrous elements, for example filaments, facilitates the movement of hydrophilic modifiers from the interior of the fibrous elements to the surfaces of the fibrous elements. Again, without being bound by theory, these polymer chain disrupters are thought to "disrupt" the crystalline or semi-crystalline polymer matrix of the fibrous elements, or in some other way increase the permeability, or increase the amorphousness of the polymer matrix, to allow a smaller functional materials like hydrophilic modifiers to migrate to the surface of the fibrous elements without subjecting to elevated heat and humidity. Non-limiting examples of these semi-crystalline/crystalline polymers that are typically used to make thermoplastic fibrous elements and coform fibrous structures containing such fibrous elements and their polymer chain disrupters include the following combinations: polylactic acid-L isomer (semi-crystalline/crystalline) and polylactic acid-D isomer (polymer chain disrupter); isotactic polypropylene (semi-crystalline/crystalline) and atactic polypropylene (polymer chain disrupter); isotactic polypropylene (semi-crystalline/crystalline), such as LyondellBasell's 650W, and propylene/ethylene block copolymer (polymer chain disrupter), such as ExxonMobil's Vistamaxx 7050FL.

In one example of the present invention, a coform fibrous structure, for example a non-elastic coform fibrous structure, comprising a. a core component comprising a plurality of solid additives, for example pulp fibers, such as wood pulp fibers, and a plurality of core fibrous elements, for example core filaments, wherein for example the plurality of solid additives are dispersed throughout, for example randomly dispersed throughout, the core fibrous elements; and b. a first scrim component associated with the core component, for example via thermal bonding, wherein the first scrim component comprises a plurality of first scrim fibrous elements wherein at least one of the first scrim fibrous elements comprises a polymer comprising a polymer chain disrupter and a hydrophilic modifier, is provided.

In another example of the present invention, a coform fibrous structure, for example a non-elastic coform fibrous structure, comprising a. a core component comprising a plurality of solid additives, for example pulp fibers, such as wood pulp fibers, and a plurality of core fibrous elements, for example core filaments, wherein for example the plurality of solid additives are dispersed throughout, for example randomly dispersed throughout, the core fibrous elements; and b. a first scrim component associated with the core component, for example via thermal bonding, wherein the first scrim component comprises a plurality of first scrim fibrous elements;

wherein at least one of the core fibrous elements and the first scrim fibrous elements comprises a polymer (the fibrous elements are made from a polymer composition comprising a polymer) comprising a polymer chain disrupter and a hydrophilic modifier, is provided.

In another example of the present invention, a composite fibrous structure, for example a non-elastic composite fibrous structure, comprising:

a. a first wet-laid fibrous structure, for example a paper web; and b. a coform fibrous structure associated with the wet-laid fibrous structure, wherein the coform fibrous structure according to the present invention, for example a non-elastic coform fibrous structure, comprises:

i. a core component comprising a plurality of solid additives, for example pulp fibers, such as wood pulp fibers, and a plurality of core fibrous elements, for example core filaments, wherein for example the plurality of solid additives are dispersed throughout, for example randomly dispersed throughout, the core fibrous elements; and ii. a first scrim component associated with the core component, for example via thermal bonding, wherein the first scrim component comprises a plurality of first scrim fibrous elements wherein at least one of the first scrim fibrous elements comprises a polymer comprising a polymer chain disrupter and a hydrophilic modifier, is provided.

In another example of the present invention, a composite fibrous structure, for example a non-elastic composite fibrous structure, comprising:

a. a first wet-laid fibrous structure, for example a paper web; and b. a coform fibrous structure associated with the wet-laid fibrous structure, wherein the coform fibrous structure according to the present invention, for example a non-elastic coform fibrous structure, comprises:

i. a core component comprising a plurality of solid additives, for example pulp fibers, such as wood pulp fibers, and a plurality of core fibrous elements, for example core filaments, wherein for example the plurality of solid additives are dispersed throughout, for example randomly dispersed throughout, the core fibrous elements; and ii. a first scrim component associated with the core component, for example via thermal bonding, wherein the first scrim component comprises a plurality of first scrim fibrous elements;

wherein at least one of the core fibrous elements and the first scrim fibrous elements comprises a polymer comprising a polymer chain disrupter and a hydrophilic modifier, is provided.

In even another example of the present invention, a multi-ply fibrous structure, for example a multi-ply sanitary tissue product, for example a multi-ply absorbent article, such as a multi-ply paper towel, comprising a first fibrous structure ply comprising a composite fibrous structure according to the present invention and a second fibrous structure ply, for example a wet-laid fibrous structure ply, which may be associated with the composite fibrous structure ply by one or more bonds, for example one or more thermal bonds and/or one or more adhesive bonds such as plybond glue bonds.

In one example, the multi-ply fibrous structure comprises a first fibrous structure ply comprising a composite fibrous structure according to the present invention and a second fibrous structure ply. In one example, the second fibrous structure ply comprises a wet-laid fibrous structure. In one example, the wet-laid fibrous structure comprises a plurality of pulp fibers, for example wood pulp fibers, such as wood pulp fibers selected from the group consisting of: hardwood pulp fibers, softwood pulp fibers, and mixtures thereof. In one example, the wet-laid fibrous structure comprises non-wood pulp fibers, for example trichomes.

In still another example of the present invention, an absorbent article, for example a non-elastic absorbent article, for example a paper towel, comprising a coform fibrous structure and/or a composite fibrous structure and/or a composite fibrous structure and wet-laid fibrous structure such that the absorbent article exhibits a Pad Sink Time of less than 6.0 seconds and/or less than 5.5 seconds and/or less than 5.0 seconds and/or less than 4.5 seconds and/or less than 4.0 seconds and/or about or greater than 0 seconds within less than 30 days and/or less than 25 days and/or less than 20 days and/or less than 15 days and/or less than 10 days and/or less than 5 days and/or less than 3 days after production (spinning of the fibrous elements)) without subjecting the absorbent articles to 50° C. or greater and relative humidity of 60% or greater Pad Sink Times as measured by the Pad Sink Test Method described herein, is provided.

In still another example of the present invention, a method for making a composite fibrous structure according to the present invention comprising the step of associating a coform fibrous structure according to the present invention with a wet-laid fibrous structure, is provided.

In even still another example of the present invention, a method for making a composite fibrous structure comprising the step of combining a wet-laid fibrous structure with a coform fibrous structure according to the present invention to make a composite fibrous structure according to the present invention, is provided.

In even yet another example of the present invention, a method for making an absorbent article comprising the steps of:

a. providing a composite fibrous structure according to the present invention;

b. providing a wet-laid fibrous structure; and c. combining the composite fibrous structure with the wet-laid fibrous structure to make the absorbent article, is provided.

The present invention provides a coform fibrous structures, composite fibrous structures, and/or absorbent articles comprising such coform fibrous structures and/or composite fibrous structures that are fast-wetting according to the present invention, and method for making same.

DETAILED DESCRIPTION OF THE INVENTION

Figure 1:
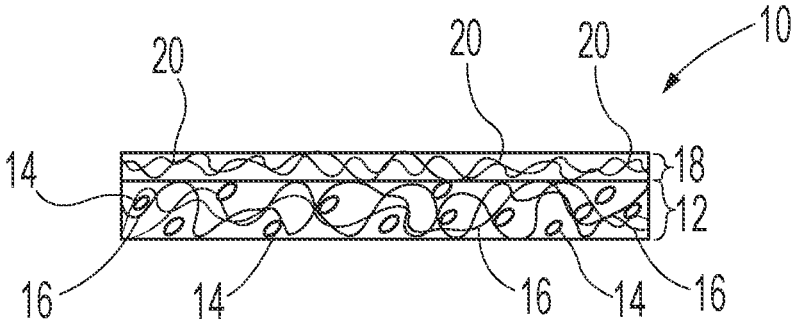
FIG. 1 is a schematic representation of an example of a coform fibrous structure according to the present invention.

"Polymer chain disrupter" as used herein means a polymer component, for example a minor polymer component (less than 10% and/or less than 5% and/or less than 3% and/or less than 2% and/or from about 0.3% to about 1.5% and/or from about 0.6% to about 1.5% by weight of the polymer chain from the minor polymer component and the major/primary polymer component) such as a monomeric unit, that is polymerized with one or more different monomeric units, to form a fibrous element, for example a filament that exhibits different properties than if the fibrous element, for example the filament, was produced from 100% by weight of the major/primary component.

"Different Monomeric Units" as used herein with respect to a polymer means that the polymer is derived from 1) two or more different isomers, for example an L-isomer such as L-Polylactic Acid and D-isomer such as D-Polylactic Acid, and/or 2) two or more differently aligned monomeric units, for example atactic or random alignment rather than isotactic or same alignment, which results in a more crystalline polymer within a filament made from the polymer and/or 3) two or more different monomeric units for example a propylene, such as a portion of a homopolymer of propylene (polypropylene) such as LyondellBasell's 650W and a copolymer, for example a block copolymer of propylene-polyethylene block copolymer such as ExxonMobil's Vistamaxx 7050FL.

"Article" as used herein means a consumer-usable structure comprising one or more and/or two or more and/or three or more and/or four or more fibrous structures and/or webs according to the present invention. In one example the article is a dry article. In another example the article is an absorbent article. In addition, the article may be a sanitary tissue product. The article may comprise two or more and/or three or more different fibrous webs selected from the group consisting of various fibrous structures (fibrous webs) such as wet-laid fibrous webs, air-laid fibrous webs, coform fibrous web, meltblown fibrous web, and spunbond fibrous web, composite fibrous webs. In one example, the article is void of a hydroentangled fibrous web and/or is not a hydroentangled fibrous web. In another example, the article is void of a carded fibrous web and/or is not a carded fibrous web. In addition to the fibrous webs, the articles of the present invention may comprise other solid matter, such as sponges, foams, particle, such as absorbent gel materials, and mixtures thereof.

In one example, two or more fibrous webs (fibrous web plies) of the present invention may be associated together to form the article.

In one example, the article of the present invention comprises one or more coform fibrous webs (coform fibrous web plies). In addition to the coform fibrous web, the article may further comprise one or more wet-laid fibrous webs (wet-laid fibrous web plies). Also in addition to the coform fibrous web (coform fibrous web ply) with or without one or more wet-laid fibrous webs (wet-laid fibrous web plies), the article may further comprise one or more meltblown fibrous webs (meltblown fibrous web plies).

In another example, the article of the present invention may comprise one or more multi-fibrous element fibrous webs (e.g., a fibrous structure comprising a mixture of filaments and fibers), such as a coform fibrous web, and one or more mono-fibrous element fibrous webs (e.g., a fibrous structure comprising only fibers or only filaments, not a mixture of fibers and filaments), such as a paper web, for example a fibrous web and/or a meltblown fibrous web.

In one example, at least a portion of the article exhibits a basis weight of about 150 gsm or less and/or about 100 gsm or less and/or from about 30 gsm to about 95 gsm.

"Sanitary tissue product" as used herein means a soft, low density (i.e. <about 0.15 g/cm$^3$) web useful as a wiping implement for post-urinary and post-bowel movement cleaning (toilet tissue), for otorhinolaryngological discharges (facial tissue), and multi-functional absorbent and cleaning uses (absorbent towels). Non-limiting examples of suitable sanitary tissue products of the present invention include paper towels, bath tissue, facial tissue, napkins, baby wipes, adult wipes, wet wipes, cleaning wipes, polishing wipes, cosmetic wipes, car care wipes, wipes that comprise an active agent for performing a particular function, cleaning substrates for use with implements, such as a Swiffer® cleaning wipe/pad. The sanitary tissue product may be convolutedly wound upon itself about a core or without a core to form a sanitary tissue product roll.

The sanitary tissue products of the present invention may exhibit a basis weight between about 10 $g/m^2$ to about 500 $g/m^2$ and/or from about 15 $g/m^2$ to about 400 $g/m^2$ and/or from about 20 $g/m^2$ to about 300 $g/m^2$ and/or from about 20 $g/m^2$ to about 200 $g/m^2$ and/or from about 20 $g/m^2$ to about 150 $g/m^2$ and/or from about 20 $g/m^2$ to about 120 $g/m^2$ and/or from about 20 $g/m^2$ to about 110 $g/m^2$ and/or from about 20 $g/m^2$ to about 100 $g/m^2$ and/or from about 30 to 90 $g/m^2$. In addition, the sanitary tissue product of the present invention may exhibit a basis weight between about 40 $g/m^2$ to about 500 $g/m^2$ and/or from about 50 $g/m^2$ to about 400 $g/m^2$ and/or from about 55 $g/m^2$ to about 300 $g/m^2$ and/or from about 60 to 200 $g/m^2$. In one example, the sanitary tissue product exhibits a basis weight of less than 100 $g/m^2$ and/or less than 80 $g/m^2$ and/or less than 75 $g/m^2$ and/or less than 70 $g/m^2$ and/or less than 65 $g/m^2$ and/or less than 60 $g/m^2$ and/or less than 55 $g/m^2$ and/or less than 50 $g/m^2$ and/or less than 47 $g/m^2$ and/or less than 45 $g/m^2$ and/or less than 40 $g/m^2$ and/or less than 35 $g/m^2$ and/or to greater than 20 $g/m^2$ and/or greater than 25 $g/m^2$ and/or greater than 30 $g/m^2$ as measured according to the Basis Weight Test Method described herein.

The sanitary tissue products of the present invention may exhibit a density (measured at 95 $g/in^2$) of less than about 0.60 $g/cm^3$ and/or less than about 0.30 $g/cm^3$ and/or less than about 0.20 $g/cm^3$ and/or less than about 0.10 $g/cm^3$ and/or less than about 0.07 $g/cm^3$ and/or less than about 0.05 $g/cm^3$ and/or from about 0.01 $g/cm^3$ to about 0.20 $g/cm^3$ and/or from about 0.02 $g/cm^3$ to about 0.10 $g/cm^3$.

The sanitary tissue products of the present invention may comprises additives such as softening agents, temporary wet strength agents, permanent wet strength agents, bulk softening agents, silicones, wetting agents, latexes, especially surface-pattern-applied latexes, dry strength agents such as carboxymethylcellulose and starch, and other types of additives suitable for inclusion in and/or on sanitary tissue products.

"Fibrous web" as used herein means a unitary structure comprising one or more fibrous structures that are associated with one another, such as by compression bonding (for example by passing through a nip formed by two rollers), thermal bonding (for example by passing through a nip formed by two rollers where at least one of the rollers is heated to a temperature of at least about 120° C. (250° F.), microselfing, needle punching, and gear rolling, to form the unitary structure, for example a unitary structure that exhibits sufficient integrity to be processed with web handling equipment and/or exhibits a basis weight of at least 6 gsm and/or at least 8 gsm and/or at least 10 gsm and/or at least 15 gsm and/or at least 20 gsm and/or at least 30 gsm and/or at least 40 gsm. The unitary structure may also be referred to as a ply, a fibrous web ply.

"Fibrous structure" as used herein means a structure that comprises a plurality of fibrous elements, for example a plurality of filaments and/or a plurality of fibers, for example pulp fibers, for example wood pulp fibers, and/or cellulose fibrous elements and/or cellulose fibers, such as pulp fibers, for example wood pulp fibers. In addition to the fibrous elements, the fibrous structures may comprise other solid additives, for example particles, such as absorbent gel material particles. In one example, a fibrous structure according to the present invention means an orderly arrangement of fibrous elements within a structure in order to perform a function. In another example, a fibrous structure according to the present invention is a nonwoven. In one example, the fibrous structures of the present invention may comprise wet-laid fibrous structures, for example embossed conventional wet pressed fibrous structures, through-air-dried (TAD) fibrous structures both creped and/or uncreped, belt-creped fibrous structures, fabric-creped fibrous structures, and combinations thereof, air-laid fibrous structures, such as thermally-bonded air-laid (TBAL) fibrous structures, melt-bonded air-laid (MBAL), latex-bonded air-laid (LBAL) fibrous structures and combinations thereof, coform fibrous structures, meltblown fibrous structures, and spunbond fibrous structures, carded fibrous structures, and combinations thereof. In one example, the fibrous structure is a non-hydroentangled fibrous structure. In another example, the fibrous structure is a non-carded fibrous structure.

In another example of the present invention, a fibrous structure comprises a plurality of inter-entangled fibrous elements, for example inter-entangled filaments.

Non-limiting examples of fibrous structures and/or fibrous webs (fibrous web plies) of the present invention include paper.

The fibrous structures of the present invention may be homogeneous or may be layered. If layered, the fibrous structures may comprise at least two and/or at least three and/or at least four and/or at least five layers.

Any one of the fibrous structures may itself be a fibrous web (fibrous web ply) if the fibrous structure exhibits sufficient integrity to be processed with web handling equipment and/or exhibits a basis weight of at least 6 gsm and/or at least 8 gsm and/or at least 10 gsm and/or at least 15 gsm and/or at least 20 gsm and/or at least 30 gsm and/or at least 40 gsm. An example of such a fibrous structure, for example a paper web, for example a fibrous structure exhibiting a basis weight of at least 10 gsm and/or at least 15 gsm and/or at least 20 gsm can be a fibrous web (fibrous web ply) itself.

Non-limiting examples of processes for making the fibrous structures of the present invention include known wet-laid papermaking processes, for example conventional wet-pressed (CWP) papermaking processes and through-air-dried (TAD), both creped TAD and uncreped TAD, papermaking processes, and air-laid papermaking processes. Such processes typically include steps of preparing a fiber composition in the form of a fiber suspension in a medium, either wet, more specifically aqueous medium, or dry, more specifically gaseous, i.e. with air as medium. The aqueous medium used for wet-laid processes is oftentimes referred to as a fiber slurry. The fiber slurry is then used to deposit a plurality of the fibers onto a forming wire, fabric, or belt such that an embryonic web material is formed, after which drying and/or bonding the fibers together results in a fibrous structure and/or fibrous web (fibrous web ply). Further processing of the fibrous structure and/or fibrous web (fibrous web ply) may be carried out such that a fibrous structure and/or fibrous web (fibrous web ply) is formed. For example, in typical papermaking processes, the fibrous structure and/or fibrous web (fibrous web ply) is wound on the reel at the end of papermaking, often referred to as a parent roll, and may subsequently be converted into a fibrous web (fibrous web ply) of the present invention and/or ultimately incorporated into an article, such as a single- or multi-ply sanitary tissue product.

"Multi-fibrous element fibrous structure" as used herein means a fibrous structure that comprises filaments and fibers, for example a coform fibrous structure is a multi-fibrous element fibrous structure.

"Mono-fibrous element fibrous structure" as used herein means a fibrous structure that comprises only fibers or filaments, for example a paper web, such as a paper web, for example a fibrous structure, or meltblown fibrous structure, such as a scrim, respectively, not a mixture of fibers and filaments.

"Coform fibrous structure" as used herein means that the fibrous structure comprises a mixture of filaments, for example meltblown filaments, such as thermoplastic filaments, for example polypropylene filaments, and fibers, such as pulp fibers, for example wood pulp fibers. The filaments and fibers are commingled together to form the coform fibrous structure. The coform fibrous structure may be associated with one or more meltblown fibrous structures and/or spunbond fibrous structures, which form a scrim (in one example the scrim may be present at a basis weight of greater than 0.5 gsm to about 5 gsm and/or from about 1 gsm to about 4 gsm and/or from about 1 gsm to about 3 gsm and/or from about 1.5 gsm to about 2.5 gsm), such as on one or more surfaces of the coform fibrous structure.

The coform fibrous structure of the present invention may be made via a suitable coforming process.

"Fibrous element" as used herein means an elongate particulate having a length greatly exceeding its average diameter, i.e. a length to average diameter ratio of at least about 10. A fibrous element may be a filament or a fiber. In one example, the fibrous element is a single fibrous element rather than a yarn comprising a plurality of fibrous elements.

The fibrous elements of the present invention may be spun from polymer melt compositions via suitable spinning operations, such as meltblowing and/or spunbonding and/or they may be obtained from natural sources such as vegetative sources, for example trees.

The fibrous elements of the present invention may be monocomponent and/or multicomponent. For example, the fibrous elements may comprise bicomponent fibers and/or filaments. The bicomponent fibers and/or filaments may be in any form, such as side-by-side, core and sheath, islands-in-the-sea and the like.

"Filament" as used herein means an elongate particulate as described above that exhibits a length of greater than or equal to 5.08 cm (2 in.) and/or greater than or equal to 7.62 cm (3 in.) and/or greater than or equal to 10.16 cm (4 in.) and/or greater than or equal to 15.24 cm (6 in.).

Filaments are typically considered continuous or substantially continuous in nature. Filaments are relatively longer than fibers. Non-limiting examples of filaments include meltblown and/or spunbond filaments. Non-limiting examples of polymers that can be spun into filaments include natural polymers, such as starch, starch derivatives, cellulose, such as rayon and/or lyocell, and cellulose derivatives, hemicellulose, hemicellulose derivatives, and synthetic polymers including, but not limited to polyvinyl alcohol filaments and/or polyvinyl alcohol derivative filaments, and thermoplastic polymer filaments, such as polyesters, nylons, polyolefins such as polypropylene filaments, polyethylene filaments, and biodegradable or compostable thermoplastic fibers such as polylactic acid filaments, polyhydroxyalkanoate filaments, polyesteramide filaments, and polycaprolactone filaments. The filaments may be monocomponent or multicomponent, such as bicomponent filaments. In one example, the filaments are monocomponent filaments.

The filaments may be made via spinning, for example via meltblowing and/or spunbonding, from a polymer, for example a thermoplastic polymer, such as polyolefin, for example polypropylene and/or polyethylene, and/or polyester. Filaments are typically considered continuous or substantially continuous in nature.

"Meltblowing" is a process for producing filaments directly from polymers or resins using high-velocity air or another appropriate force to attenuate the filaments before collecting the filaments on a collection device, such as a belt, for example a patterned belt or molding member. In a meltblowing process the attenuation force is applied in the form of high speed air as the material (polymer) exits a die or spinnerette.

"Spunbonding" is a process for producing filaments directly from polymers by allowing the polymer to exit a die or spinnerette and drop a predetermined distance under the forces of flow and gravity and then applying a force via high velocity air or another appropriate source to draw and/or attenuate the polymer into a filament.

"Fiber" as used herein means an elongate particulate as described above that exhibits a length of less than 5.08 cm (2 in.) and/or less than 3.81 cm (1.5 in.) and/or less than 2.54 cm (1 in.).

Fibers are typically considered discontinuous in nature. Non-limiting examples of fibers include pulp fibers, such as wood pulp fibers, and synthetic staple fibers such as polypropylene, polyethylene, polyester, copolymers thereof, rayon, lyocell, glass fibers and polyvinyl alcohol fibers.

Staple fibers may be produced by spinning a filament tow and then cutting the tow into segments of less than 5.08 cm (2 in.) thus producing fibers; namely, staple fibers.

"Pulp fibers" as used herein means fibers that have been derived from vegetative sources, such as plants and/or trees. In one example of the present invention, "pulp fiber" refers to papermaking fibers. In one example of the present invention, a fiber may be a naturally occurring fiber, which means it is obtained from a naturally occurring source, such as a vegetative source, for example a tree and/or plant, such as trichomes. Such fibers are typically used in papermaking and are oftentimes referred to as papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to fibrous structures made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. Also applicable to the present invention are fibers derived from recycled paper, which may contain any or all of the above categories of fibers as well as other non-fibrous polymers such as fillers, softening agents, wet and dry strength agents, and adhesives used to facilitate the original papermaking.

In one example, the wood pulp fibers are selected from the group consisting of hardwood pulp fibers, softwood pulp fibers, and mixtures thereof. The hardwood pulp fibers may be selected from the group consisting of: tropical hardwood pulp fibers, northern hardwood pulp fibers, and mixtures thereof. The tropical hardwood pulp fibers may be selected from the group consisting of: eucalyptus fibers, acacia fibers, and mixtures thereof. The northern hardwood pulp fibers may be selected from the group consisting of: cedar fibers, maple fibers, and mixtures thereof.

In addition to the various wood pulp fibers, other cellulosic fibers such as cotton linters, rayon, lyocell, trichomes, seed hairs, rice straw, wheat straw, bamboo, and bagasse fibers can be used in this invention. Other sources of cellulose in the form of fibers or capable of being spun into fibers include grasses and grain sources.

"Trichome" or "trichome fiber" as used herein means an epidermal attachment of a varying shape, structure and/or function of a non-seed portion of a plant. In one example, a trichome is an outgrowth of the epidermis of a non-seed portion of a plant. The outgrowth may extend from an epidermal cell. In one embodiment, the outgrowth is a trichome fiber. The outgrowth may be a hairlike or bristle-like outgrowth from the epidermis of a plant.

Trichome fibers are different from seed hair fibers in that they are not attached to seed portions of a plant. For example, trichome fibers, unlike seed hair fibers, are not attached to a seed or a seed pod epidermis. Cotton, kapok, milkweed, and coconut coir are non-limiting examples of seed hair fibers.

Further, trichome fibers are different from nonwood bast and/or core fibers in that they are not attached to the bast, also known as phloem, or the core, also known as xylem portions of a nonwood dicotyledonous plant stem. Non-limiting examples of plants which have been used to yield nonwood bast fibers and/or nonwood core fibers include kenaf, jute, flax, ramie and hemp.

Further trichome fibers are different from monocotyledonous plant derived fibers such as those derived from cereal straws (wheat, rye, barley, oat, etc), stalks (corn, cotton, sorghum, *Hesperaloe funifera*, etc.), canes (bamboo, bagasse, etc.), grasses (esparto, lemon, sabai, switchgrass, etc), since such monocotyledonous plant derived fibers are not attached to an epidermis of a plant.

Further, trichome fibers are different from leaf fibers in that they do not originate from within the leaf structure. Sisal and abaca are sometimes liberated as leaf fibers.

Finally, trichome fibers are different from wood pulp fibers since wood pulp fibers are not outgrowths from the epidermis of a plant; namely, a tree. Wood pulp fibers rather originate from the secondary xylem portion of the tree stem.

"Basis Weight" as used herein is the weight per unit area of a sample reported in lbs/3000 $ft^2$ or $g/m^2$ (gsm) and is measured according to the Basis Weight Test Method described herein.

"Machine Direction" or "MD" as used herein means the direction parallel to the flow of the fibrous structure through the fibrous structure making machine and/or sanitary tissue product manufacturing equipment.

"Cross Machine Direction" or "CD" as used herein means the direction parallel to the width of the fibrous structure making machine and/or sanitary tissue product manufacturing equipment and perpendicular to the machine direction.

"Embossed" as used herein with respect to an article, sanitary tissue product, and/or fibrous web (fibrous web ply), means that an article, sanitary tissue product, and/or fibrous web (fibrous web ply) has been subjected to a process which converts a smooth surfaced article, sanitary tissue product, and/or fibrous web (fibrous web ply) to an out-of-plane, textured surface by replicating a pattern on one or more emboss rolls, which form a nip through which the article, sanitary tissue product and/or fibrous web (fibrous web ply) passes. Embossed does not include creping, microcreping, printing or other processes that may also impart a texture and/or decorative pattern to an article, sanitary tissue product and/or fibrous web (fibrous web ply).

"Differential density", as used herein, means an absorbent article and/or wet-laid fibrous structure and/or composite fibrous structure and/or coform fibrous structure that comprises one or more regions of relatively low fibrous element, for example filament and/or fiber, density, which are referred to as pillow regions, and one or more regions of relatively high fibrous element, for example filament and/or fiber, density, which are referred to as knuckle regions.

"Densified", as used herein means a portion of a fibrous structure and/or fibrous web (fibrous web ply) that is characterized by regions of relatively high fibrous element, e.g., fiber, density (knuckle regions).

"Non-densified", as used herein, means a portion of a fibrous structure and/or fibrous web (fibrous web ply) that exhibits a lesser fibrous element, e.g., fiber, density (one or more regions of relatively lower fibrous element, e.g., fiber, density) (pillow regions) than another portion (for example a knuckle region) of the fibrous structure and/or fibrous web (fibrous web ply).

"Wet textured" as used herein means that a three-dimensional (3D) patterned fibrous structure and/or 3D patterned fibrous web (3D patterned fibrous web ply) comprises texture (for example a three-dimensional topography) imparted to the fibrous structure and/or fibrous structure's surface and/or fibrous web's surface (fibrous web ply's surface) during a fibrous structure making process. In one example, in a paper web, for example a fibrous structure making process, wet texture may be imparted to a fibrous structure upon fibers and/or filaments being collected on a collection device that has a three-dimensional (3D) surface which imparts a 3D surface to the fibrous structure being formed thereon and/or being transferred to a fabric and/or belt, such as a through-air-drying fabric and/or a patterned drying belt, comprising a 3D surface that imparts a 3D surface to a fibrous structure being formed thereon. In one example, the collection device with a 3D surface comprises a patterned, such as a patterned formed by a polymer or resin being deposited onto a base substrate, such as a fabric, in a patterned configuration. The wet texture imparted to a paper web, for example a fibrous structure is formed in the fibrous structure prior to and/or during drying of the fibrous structure. Non-limiting examples of collection devices and/or fabric and/or belts suitable for imparting wet texture to a fibrous structure include those fabrics and/or belts used in fabric creping and/or belt creping processes, for example as disclosed in U.S. Pat. Nos. 7,820,008 and 7,789,995, coarse through-air-drying fabrics as used in uncreped through-air-drying processes, and photo-curable resin patterned through-air-drying belts, for example as disclosed in U.S. Pat. No. 4,637,859. For purposes of the present invention, the collection devices used for imparting wet texture to the fibrous structures would be patterned to result in the fibrous structures comprising a surface pattern comprising a plurality of parallel line elements wherein at least one, two, three, or more, for example all of the parallel line elements exhibit a non-constant width along the length of the parallel line elements. This is different from non-wet texture that is imparted to a fibrous structure after the fibrous structure has been dried, for example after the moisture level of the fibrous structure is less than 15% and/or less than 10% and/or less than 5%. An example of non-wet texture includes embossments imparted to a fibrous structure and/or fibrous web (fibrous web ply) by embossing rolls during converting of the fibrous structure and/or fibrous web (fibrous web ply). In one example, the fibrous structure and/or fibrous web (fibrous web ply), for example a paper web, for example a fibrous structure and/or wet-laid fibrous web (wet-laid fibrous web ply), is a wet textured fibrous structure and/or wet textured fibrous web (wet textured fibrous web ply).

"3D pattern" with respect to a fibrous structure and/or fibrous web's surface (fibrous web ply's surface) in accordance with the present invention means herein a pattern that is present on at least one surface of the fibrous structure and/or fibrous web (fibrous web ply). The 3D pattern texturizes the surface of the fibrous structure and/or fibrous web (fibrous web ply), for example by providing the surface with protrusions and/or depressions. The 3D pattern on the surface of the fibrous structure and/or fibrous web (fibrous web ply) is made by making the fibrous structure on a patterned molding member that imparts the 3D pattern to the fibrous structure made thereon. For example, the 3D pattern may comprise a series of line elements, such as a series of line elements that are substantially oriented in the cross-machine direction of the fibrous structure and/or sanitary tissue product.

In one example, a series of line elements may be arranged in a 3D pattern selected from the group consisting of: periodic patterns, aperiodic patterns, straight line patterns, curved line patterns, wavy line patterns, snaking patterns, square line patterns, triangular line patterns, S-wave patterns, sinusoidal line patterns, and mixtures thereof. In another example, a series of line elements may be arranged in a regular periodic pattern or an irregular periodic pattern (aperiodic) or a non-periodic pattern.

"Distinct from" and/or "different from" as used herein means two things that exhibit different properties and/or levels of materials, for example different by 0.5 and/or 1 and/or 2 and/or 3 and/or 5 and/or 10 units and/or different by 1% and/or 3% and/or 5% and/or 10% and/or 20%, different materials, and/or different average fiber diameters.

"Textured pattern" as used herein means a pattern, for example a surface pattern, such as a three-dimensional (3D) surface pattern present on a surface of the fibrous structure and/or on a surface of a component making up the fibrous structure.

"Fibrous Structure Basis Weight" as used herein is the weight per unit area of a sample reported in lbs/3000 $ft^2$ or $g/m^2$.

"Ply" as used herein means an individual, integral fibrous structure.

"Plies" as used herein means two or more individual, integral fibrous structures disposed in a substantially contiguous, face-to-face relationship with one another, forming a multi-ply sanitary tissue product. It is also contemplated that an individual, integral fibrous structure can effectively form a multi-ply sanitary tissue product, for example, by being folded on itself.

"Common Intensive Property" as used herein means an intensive property possessed by more than one region within a fibrous structure. Such intensive properties of the fibrous structure include, without limitation, density, basis weight, thickness, and combinations thereof. For example, if density is a common intensive property of two or more different regions, a value of the density in one region can differ from a value of the density in one or more other regions. Regions (such as, for example, a first region and a second region and/or a continuous network region and at least one of a plurality of discrete zones) are identifiable areas visually discernible and/or visually distinguishable from one another by distinct intensive properties.

"X," "Y," and "Z" designate a conventional system of Cartesian coordinates, wherein mutually perpendicular coordinates "X" and "Y" define a reference X-Y plane, and "Z" defines an orthogonal to the X-Y plane. "Z-direction" designates any direction perpendicular to the X-Y plane. Analogously, the term "Z-dimension" means a dimension, distance, or parameter measured parallel to the Z-direction. When an element, such as, for example, a molding member curves or otherwise deplanes, the X-Y plane follows the configuration of the element.

"Substantially continuous" or "continuous" region refers to an area within which one can connect any two points by an uninterrupted line running entirely within that area throughout the line's length. That is, the substantially continuous region has a substantial "continuity" in all directions parallel to the first plane and is terminated only at edges of that region. The term "substantially," in conjunction with continuous, is intended to indicate that while an absolute continuity is preferred, minor deviations from the absolute continuity may be tolerable as long as those deviations do not appreciably affect the performance of the fibrous structure (or a molding member) as designed and intended.

"Substantially semi-continuous" or "semi-continuous" region refers an area which has "continuity" in all, but at least one, directions parallel to the first plane, and in which area one cannot connect any two points by an uninterrupted line running entirely within that area throughout the line's length. The semi-continuous framework may have continuity only in one direction parallel to the first plane. By analogy with the continuous region, described above, while an absolute continuity in all, but at least one, directions is preferred, minor deviations from such a continuity may be tolerable as long as those deviations do not appreciably affect the performance of the fibrous structure.

"Discontinuous" or "discrete" regions or zones refer to discrete, and separated from one another areas or zones that are discontinuous in all directions parallel to the first plane.

"Molding member" is a structural element that can be used as a support for the mixture of filaments and solid additives that can be deposited thereon during a process of making a fibrous structure, and as a forming unit to form (or "mold") a desired microscopical geometry of a fibrous structure. The molding member may comprise any element that has the ability to impart a three-dimensional pattern to the fibrous structure being produced thereon, and includes, without limitation, a stationary plate, a belt, a cylinder/roll, a woven fabric, and a band.

"Osmotic material" as used herein is a material that absorbs liquids by transfer of the liquids across the periphery of the material forming a gelatinous substance, which imbibes the liquids and tightly holds the liquids. In one example, osmotic materials retain greater than 5 times their weight of deionized water when subjected to centrifugal forces of less than or equal to 3000 G's for 10 to 15 minutes. In comparison, typically capillary absorbents retain about 1 times their weight under similar conditions. Non-limiting examples of osmotic materials include crosslinked polyacrylic acids and/or crosslinked carboxymethyl cellulose.

"Elastic" or "Elasticity" or "Elastomeric" as used herein means a material which upon application of a biasing force is stretchable to a stretched, biased length which is at least about 150% its relaxed, unstretched length, for example the materials initial length prior to stretching, and will recover at least 50% of its elongation upon release of the stretching biasing force.

"Recover" as used herein means a material that has been stretched by application of a stretching biasing force contracts to a certain post stretching length, which is some percent of its elongation, upon termination of the biasing force. For example, if a material having a relaxed, unstretched length of 1 inch was elongated 50% by the stretching, biasing force to a stretched, biased length of 1.5 inches the material would have been elongated 50% and would have a stretched, biased length that is 150% of its relaxed, unstretched length. If this exemplary stretched material contracted, that is recovered to a length of 1.1 inches after termination of the biasing force, the material would have recovered 80% (0.4 inches) of its elongation.

"Non-elastic" as used herein means a material does not exhibit elastic properties and/or elasticity and/or elastomeric.

As used herein, the articles "a" and "an" when used herein, for example, "an anionic surfactant" or "a fiber" is understood to mean one or more of the material that is claimed or described.

All percentages and ratios are calculated by weight unless otherwise indicated. All percentages and ratios are calculated based on the total composition unless otherwise indicated.

Unless otherwise noted, all component or composition levels are in reference to the active level of that component or composition, and are exclusive of impurities, for example, residual solvents or by-products, which may be present in commercially available sources.

Coform Fibrous Structure

The absorbent articles, for example non-elastic absorbent articles of the present invention comprise a coform fibrous structure, for example a non-elastic coform fibrous structure.

The coform fibrous structures of the present invention comprise a plurality of fibrous elements, for example at least one filament, such as a plurality of filaments, and a plurality of solid additives. The filaments and the solid additives may be commingled together. In one example, the fibrous structure is a coform fibrous structure comprising filaments and solid additives. The filaments may be present in the coform fibrous structures of the present invention at a level of less than 90% and/or less than 80% and/or less than 65% and/or less than 50% and/or greater than 5% and/or greater than 10% and/or greater than 20% and/or from about 10% to about 50% and/or from about 25% to about 45% by weight of the coform fibrous structure on a dry basis.

The solid additives may be present in the fibrous structures of the present invention at a level of greater than 10% and/or greater than 25% and/or greater than 50% and/or less than 100% and/or less than 95% and/or less than 90% and/or less than 85% and/or from about 30% to about 95% and/or from about 50% to about 85% by weight of the fibrous structure on a dry basis.

The filaments and solid additives may be present in the fibrous structures of the present invention at a weight ratio of filaments to solid additive of greater than 10:90 and/or greater than 20:80 and/or less than 90:10 and/or less than 80:20 and/or from about 25:75 to about 50:50 and/or from about 30:70 to about 45:55. In one example, the filaments and solid additives are present in the fibrous structures of the present invention at a weight ratio of filaments to solid additives of greater than 0 but less than 1.

In one example, the coform fibrous structures of the present invention exhibit a basis weight of from about 10 gsm to about 1000 gsm and/or from about 10 gsm to about 500 gsm and/or from about 15 gsm to about 400 gsm and/or from about 15 gsm to about 300 gsm as measured according to the Basis Weight Test Method described herein. In another example, the coform fibrous structures of the present invention exhibit a basis weight of from about 10 gsm to about 200 gsm and/or from about 20 gsm to about 150 gsm and/or from about 25 gsm to about 125 gsm and/or from about 30 gsm to about 100 gsm and/or from about 30 gsm to about 80 gsm as measured according to the Basis Weight Test Method described herein. In still another example, the coform fibrous structures of the present invention exhibit a basis weight of from about 80 gsm to about 1000 gsm and/or from about 125 gsm to about 800 gsm and/or from about 150 gsm to about 500 gsm and/or from about 150 gsm to about 300 gsm as measured according to the Basis Weight Test Method described herein.

In one example as shown in FIG. 1, a coform fibrous structure 10, for example a non-elastic coform fibrous structure comprises a core component 12 comprising a plurality of solid additives 14, for example fibers, such as pulp fibers, for example wood pulp fibers, and a plurality of core fibrous elements 16, for example core filaments. The plurality of solid additives 14 may be dispersed, for example randomly throughout the core fibrous elements 16 within the core component 12. The coform fibrous structure 10 further comprises a scrim component 18, which may be void or substantially void of solid additives, comprising a plurality of scrim fibrous elements 20, for example scrim filaments, which may be the same and/or different for example in chemical composition as the core fibrous elements 16 and which are deposited, for example spun, onto one or more surfaces of the core component 12. In one example, the scrim fibrous elements 20 comprise a polymer comprising a polymer chain disrupter, for example a propylene/ethylene block copolymer such as Vistamaxx from ExxonMobil. In another example, both the scrim fibrous elements 20 and the core fibrous elements 16 comprise a polymer comprising a polymer chain disrupter, for example a propylene/ethylene block copolymer such as Vistamaxx from ExxonMobil. The scrim component 18 may be thermally bonded to the core component 12.

In one example, the core component 12 is the component that exhibits the greatest basis weight within the coform fibrous structure 10. In one example, the core component 12 present in the coform fibrous structure 10 and/or composite fibrous structures and/or absorbent articles of the present invention exhibits a basis weight that is greater than 50% and/or greater than 55% and/or greater than 60% and/or greater than 65% and/or greater than 70% and/or less than 100% and/or less than 95% and/or less than 90% of the total basis weight of the coform fibrous structure 10 and/or composite fibrous structure and/or absorbent article of the present invention as measured according to the Basis Weight Test Method described herein. In another example, the core component 12 exhibits a basis weight of less than 20 gsm and/or less than 15 gsm and/or less than 12 gsm and/or less than 10 gsm and/or less than 8 gsm and/or less than 6 gsm and/or greater than 2 gsm and/or greater than 4 gsm as measured according to the Basis Weight Test Method described herein.

In one example, at least one of the core components of the fibrous structure comprises a plurality of solid additives, for example pulp fibers, such as comprise wood pulp fibers and/or non-wood pulp fibers.

In one example, at least one of the core components of the fibrous structure comprises a plurality of core filaments. In another example, at least one of the core components comprises a plurality of solid additives and a plurality of the core filaments. In one example, the solid additives and the core filaments are present in a layered orientation within the core component. In one example, the core filaments are present as a layer between two solid additive layers. In another example, the solid additives and the core filaments are present in a coform layer. At least one of the core filaments comprises a polymer, for example a thermoplastic polymer, such as a polyolefin. The polyolefin may be selected from the group consisting of: polypropylene, polyethylene, and mixtures thereof. In another example, the thermoplastic polymer of the core filament may comprise a polyester.

In one example, the scrim component 18 exhibits a basis weight that is less than 25% and/or less than 20% and/or less than 15% and/or less than 10% and/or less than 7% and/or less than 5% and/or greater than 0% and/or greater than 1% of the total basis weight of the coform fibrous structure and/or composite fibrous structure and/or absorbent article of the present invention as measured according to the Basis Weight Test Method described herein. In another example, the scrim component 18 exhibits a basis weight of 10 gsm or less and/or less than 10 gsm and/or less than 8 gsm and/or less than 6 gsm and/or greater than 5 gsm and/or less than 4 gsm and/or greater than 0 gsm and/or greater than 1 gsm as measured according to the Basis Weight Test Method described herein.

Figure 2:
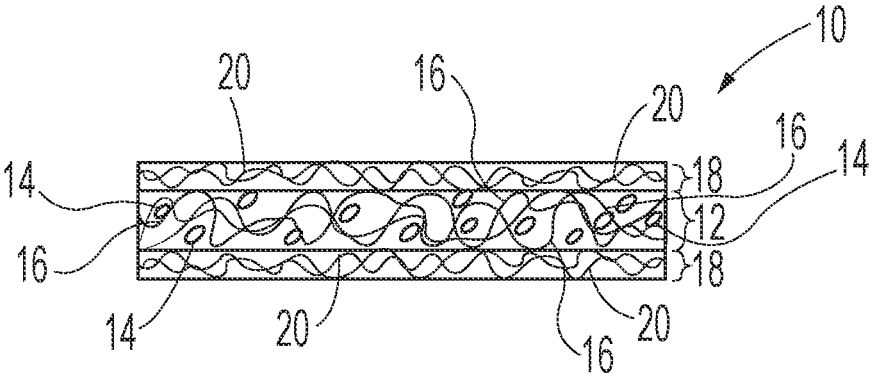
FIG. 2 is a schematic representation of another example of a coform fibrous structure according to the present invention.

In one example, at least one scrim component 12 is adjacent to at least one core component 12 within the coform fibrous structure 10. In another example, at least one core component 12 is positioned between two scrim components 18 within the coform fibrous structure 10 as shown in FIG. 2.

In one example, at least one of the scrim components of the coform fibrous structure of the present invention comprises a plurality of scrim filaments, for example scrim filaments, wherein the scrim filaments comprise a polymer, for example a thermoplastic and/or hydroxyl polymer as described above with reference to the core components and also further comprises a polymer chain disrupter.

In one example, at least one of the scrim filaments exhibits an average fiber diameter of less than 50 and/or less than 25 and/or less than 10 and/or at least 1 and/or greater than 1 and/or greater than 3 μm as measured according to the Average Diameter Test Method described herein.

The average fiber diameter of the core filaments is less than 250 and/or less than 200 and/or less than 150 and/or less than 100 and/or less than 50 and/or less than 30 and/or less than 25 and/or less than 10 and/or greater than 1 and/or greater than 3 μm as measured according to the Average Diameter Test Method described herein.

In one example, the coform fibrous structures of the present invention may comprise any suitable amount of filaments (core filaments and/or scrim filaments) and any suitable amount of solid additives. For example, the coform fibrous structures may comprise from about 10% to about 70% and/or from about 20% to about 60% and/or from about 30% to about 50% by dry weight of the coform fibrous structure of filaments and from about 90% to about 30% and/or from about 80% to about 40% and/or from about 70% to about 50% by dry weight of the coform fibrous structure of solid additives, such as wood pulp fibers.

In one example, the filaments and solid additives of the present invention may be present in the coform fibrous structures according to the present invention at weight ratios of filaments to solid additives of from at least about 1:1 and/or at least about 1:1.5 and/or at least about 1:2 and/or at least about 1:2.5 and/or at least about 1:3 and/or at least about 1:4 and/or at least about 1:5 and/or at least about 1:7 and/or at least about 1:10.

In one example, the solid additives, for example wood pulp fibers, may be selected from the group consisting of softwood kraft pulp fibers, hardwood pulp fibers, and mixtures thereof. Non-limiting examples of hardwood pulp fibers include fibers derived from a fiber source selected from the group consisting of: Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, and Magnolia. Non-limiting examples of softwood pulp fibers include fibers derived from a fiber source selected from the group consisting of: Pine, Spruce, Fir, Tamarack, Hemlock, Cypress, and Cedar. In one example, the hardwood pulp fibers comprise tropical hardwood pulp fibers. Non-limiting examples of suitable tropical hardwood pulp fibers include Eucalyptus pulp fibers, Acacia pulp fibers, and mixtures thereof.

In one example, the wood pulp fibers comprise softwood pulp fibers derived from the kraft process and originating from southern climates, such as Southern Softwood Kraft (SSK) pulp fibers. In another example, the wood pulp fibers comprise softwood pulp fibers derived from the kraft process and originating from northern climates, such as Northern Softwood Kraft (NSK) pulp fibers.

The wood pulp fibers present in the coform fibrous structure may be present at a weight ratio of softwood pulp fibers to hardwood pulp fibers of from 100:0 and/or from 90:10 and/or from 86:14 and/or from 80:20 and/or from 75:25 and/or from 70:30 and/or from 60:40 and/or about 50:50 and/or to 0:100 and/or to 10:90 and/or to 14:86 and/or to 20:80 and/or to 25:75 and/or to 30:70 and/or to 40:60. In one example, the weight ratio of softwood pulp fibers to hardwood pulp fibers is from 86:14 to 70:30.

In one example, the fibrous structures of the present invention comprise one or more trichomes. Non-limiting examples of suitable sources for obtaining trichomes, especially trichome fibers, are plants in the Labiatae (Lamiaceae) family commonly referred to as the mint family Examples of suitable species in the Labiatae family include *Stachys byzantina*, also known as *Stachys lanata* commonly referred to as lamb's ear, woolly betony, or woundwort. The term *Stachys byzantina* as used herein also includes cultivars *Stachys byzantina* 'Primrose Heron', *Stachys byzantina* 'Helene von Stein' (sometimes referred to as *Stachys byzantina* 'Big Ears'), *Stachys byzantina* 'Cotton Boll', *Stachys byzantina* 'Variegated' (sometimes referred to as *Stachys byzantina* 'Striped Phantom'), and *Stachys byzantina* 'Silver Carpet'.

Non-limiting examples of suitable polypropylenes for making the fibrous elements, for example filaments of the present invention are commercially available from LyondellBasell and Exxon-Mobil.

Any hydrophobic or non-hydrophilic materials within the coform fibrous structure, such as the thermoplastic fibrous elements, for example the polypropylene filaments, may be surface treated and/or melt treated with a hydrophilic modifier. Non-limiting examples of surface treating hydrophilic modifiers include surfactants, such as Triton X-100. Non-limiting examples of melt treating hydrophilic modifiers that are added to the polymer composition (polymer melt), such as the polypropylene melt, prior to spinning filaments, include hydrophilic modifying melt additives such as VW351 and/or S-1416 commercially available from Polyvel, Inc. and Irgasurf commercially available from Ciba. The hydrophilic modifier may be associated with the hydrophobic or non-hydrophilic material at any suitable level known in the art. In one example, the hydrophilic modifier is associated with the polymer composition, such as the hydrophobic and/or non-hydrophilic material within the polymer composition at a level of greater than 0% to less than about 20% and/or greater than 0% to less than about 15% and/or greater than 0.1% to less than about 10% and/or greater than 0.1% to less than about 5% and/or greater than 0.5% to less than about 3% by dry weight of the hydrophobic or non-hydrophilic material. In another example, the hydrophilic modifier may be present in the fibrous elements at a level of from about 0.1% to about 10% and/or from about 0.5% to about 7% and/or from about 1% to about 5% by weight of the fibrous elements.

a. Method for Making a Coform Fibrous Structure

A non-limiting example of a method for making a coform fibrous structure according to the present invention comprises the steps of: 1) collecting a mixture of fibrous elements, for example filaments, and solid additives, such as fibers, for example pulp fibers, onto a collection device, for example a through-air-drying fabric or other fabric or a patterned molding member of the present invention. This step of collecting the filaments and solid additives on the collection device may comprise subjecting the coform fibrous structure while on the collection device to a consolidation step whereby the coform fibrous structure, while present on the collection device, is pressed between a nip, for example a nip formed by a flat or even surface rubber roll and a flat or even surface or patterned, heated (with oil) or unheated metal roll.

In another example, the coforming method may comprise the steps of a) collecting a plurality of filaments onto a collection device, for example a belt or fabric, such as a patterned molding member, to form a scrim component. The collection of the plurality of filaments onto the collection device to form the scrim component may be vacuum assisted by a vacuum box.

Once the scrim component is formed on the collection device, the next step is to mix, such as commingle, a plurality of solid additives, such as fibers, for example pulp fibers, such as wood pulp fibers, with a plurality of filaments, such as in a coform box, and collecting the mixture on the scrim component carried on the collection device to form a core component. Optionally, an additional scrim component comprising filaments may be added to the core component to sandwich the core component between two scrim components.

The meltblown die used to make the meltblown fibrous structures and/or filaments herein may be a multi-row capillary die and/or a knife-edge die. In one example, the meltblown die is a multi-row capillary die.

b. Non-Limiting Example for Making a Coform Fibrous Structure

A 2.0 gsm scrim component (of the coform fibrous structure) comprising meltblown filaments (scrim filaments) is laid down upon a collection device, for example an Albany International Velostat170pc740 belt ("forming fabric"), (available from Albany International, Rochester, NH) traveling at 556 ft/min. The meltblown filaments of the scrim components are comprised of a blend of 42.8% LyondellBasell MF650x (polypropylene), 25% LyondellBasell MF650w (polypropylene), 15.2% Total 3866 (polypropylene), 5% Polyvel VW351 (hydrophilic modifier), 2% Ampacet 412951 (opacifier), and 10% Vistamaxx 7050FL (polymer chain disrupter) and are spun from a die, for example a multi-row capillary Biax-Fiberfilm die (Biax-Fiberfilm Corporation, Greenville, WI), at a mass flow of 126.7 g/min and a ghm of 0.206 and is attenuated with 14.82 kg/min of 204° C. (400° F.) air and quenched with two external mix, air atomized quench nozzle delivery 25 L/hr of water using 0.25 kg/min of atomization air.

The core component (5.6 gsm pulp fibers/2.0 gsm filaments) of the coform fibrous structure is prepared as follows. Solid additives, for example fibers, in this case pulp fibers, namely, 490 grams per minute of Resolute CoosAbsorbST semi-treated SSK, are fed into a hammer mill and individualized into fibers, for example cellulose pulp fibers, which are pneumatically conveyed, for example by an eductor, example of which is described in U.S. Patent Publication No. US 2016/0354736A1, into a coforming box, example of which is described in U.S. Patent Publication No. US 2016/0355950A1 filed Dec. 16, 2015, which is incorporated herein by reference. In the coforming box, the fibers, for example pulp fibers, are commingled with meltblown filaments (core filaments). The meltblown filaments are comprised of a blend of 45.4% LyondellBasell MF650x (polypropylene), 26.5% LyondellBasell MF650w (polypropylene), 16.1% Total 3866 (polypropylene), 5% Polyvel VW351 (hydrophilic modifier), 2% Ampacet 412951 (opacifier), and 5% Vistamaxx 7050FL (polymer chain disrupter). The meltblown filaments are spun from a die, for example a multi-row capillary Biax-Fiberfilm die, at a ghm of 0.206 and a total mass flow of 126.7 g/min. The meltblown filaments are attenuated with 15.65 kg/min of about 204° C. (400° F.) air. The mixture (commingled) fibers, for example cellulose pulp fibers and meltblown filaments are then laid on top of the already formed 1.0 gsm scrim component to form the coform fibrous structure.

Optionally, a second scrim component is added to the top of the non-scrimmed side of the core component (the top side of the coform fibrous structure formed immediately above). This second scrim component is a 1.6 gsm scrim component comprising meltblown filaments (scrim filaments) comprised of a blend of 45.4% LyondellBasell MF650x (polypropylene), 26.5% LyondellBasell MF650w (polypropylene), 16.1% Total 3866 (polypropylene), 5% Polyvel VW351 (hydrophilic modifier), 2% Ampacet 412951 (opacifier), and 5% Vistamaxx 7050FL (polymer chain disrupter) that are spun from a die, for example a multi-row capillary Biax-Fiberfilm die, at a ghm of 0.165 and a total mass flow of 101.6 g/min. The meltblown filaments are attenuated with 16.3 kg/min of about 204° C. (400° F.) air and are laid down on top of the core component of the coform fibrous structure such that the core component is positioned between the already formed first (2.0 gsm) scrim component and the second (1.6 gsm) scrim component.

Composite Fibrous Structure

The composite fibrous structure, for example non-elastic composite fibrous structure of the present invention comprises a wet-laid fibrous structure, for example a paper web, and a coform fibrous structure of the present invention.

Figure 3:
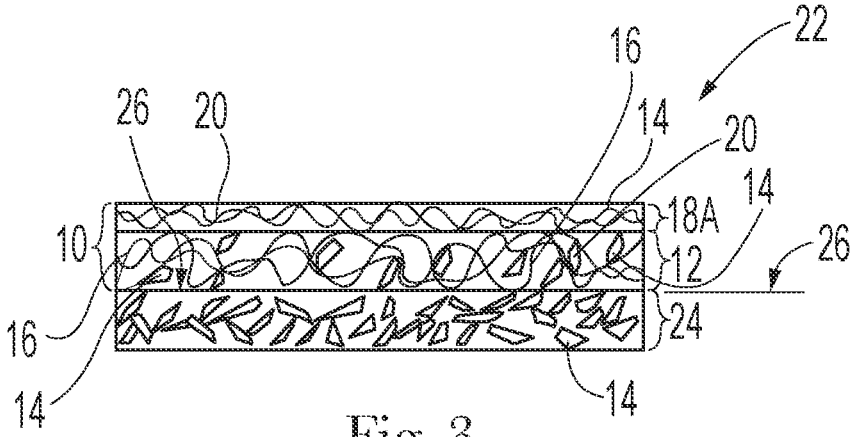
FIG. 3 is a schematic representation of an example of a composite fibrous structure according to the present invention.

As shown in FIG. 3, a composite fibrous structure 22 of the present invention comprises a wet-laid fibrous structure 24, for example a wet-laid fibrous structure comprising fibers, for example pulp fibers, such as wood pulp fibers and/or non-wood pulp fibers, and a coform fibrous structure 10 as described in FIG. 1 above. The wet-laid fibrous structure 24 is associated with the coform fibrous structure 10 for example by forming the core component 12 directly onto a surface 26 of the wet-laid fibrous structure 24 and then forming a first scrim component 18A directly onto the core component 12 as generally described above.

In one example, the wet-laid fibrous structure comprises at least one scrim material that forms an exterior surface of the composite fibrous structure.

Figure 4:
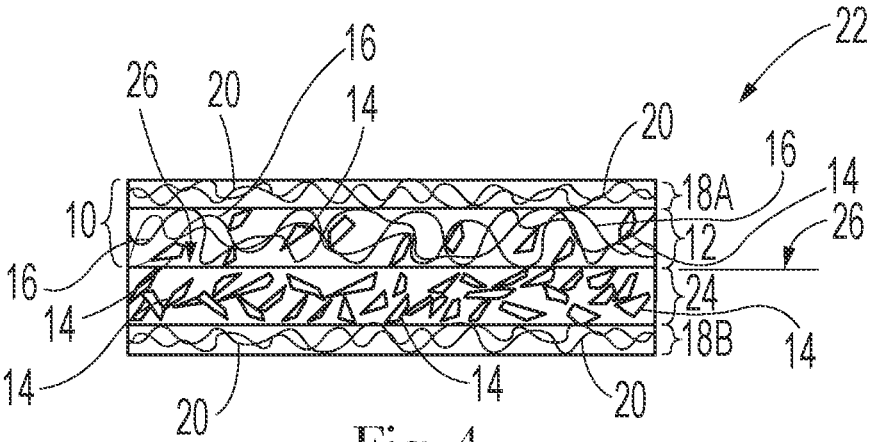
FIG. 4 is a schematic representation of another example of a composite fibrous structure according to the present invention.

In another example as shown in FIG. 4, a composite fibrous structure 22 of the present invention comprises a wet-laid fibrous structure 24, for example a wet-laid fibrous structure comprising fibers, for example pulp fibers, such as wood pulp fibers and/or non-wood pulp fibers, and a coform fibrous structure 10 as described in FIG. 1 above. The wet-laid fibrous structure 24 is associated with the coform fibrous structure 10 for example by forming the core component 12 directly onto a surface 26 of the wet-laid fibrous structure 24 and then forming a first scrim component 18A directly onto the core component 12 as generally described above. In this example, a second scrim component 18B comprising scrim filaments 20 is formed first in sequence as generally described above and then the wet-laid fibrous structure 24 is unwound upon the second scrim component 18B. Then the core component 12 is formed directly onto a surface 26 of the wet-laid fibrous structure 24 and then the first scrim component 18A is directly formed onto the core component 12 as generally described above resulting in the core component 12 being positioned between the wet-laid fibrous structure 24 and the first scrim component 18A.

Figure 5:
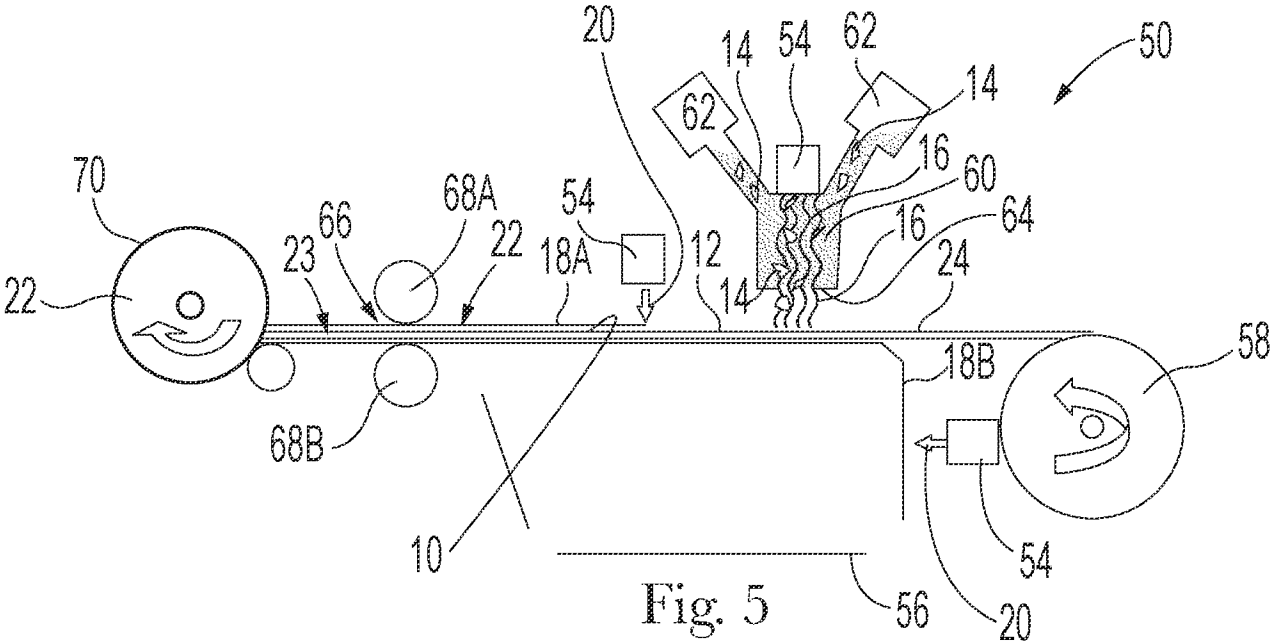
FIG. 5 is a schematic representation of an example of a method for making a composite fibrous structure according to the present invention.
Figure 6:
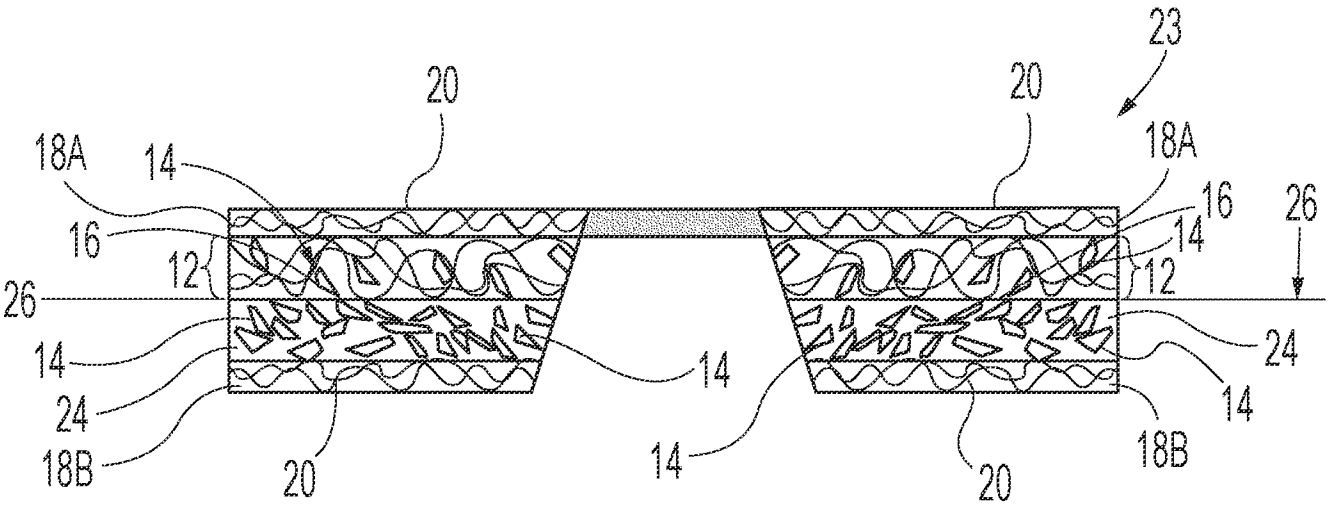
FIG. 6 is a schematic representation of an example of a patterned composite fibrous structure according to the present invention.

As shown in FIG. 5, an example of a method 50 for making a composite fibrous structure 22 comprises the steps of:

a. spinning scrim filaments 20 via a die 54, for example a multi-row capillary die, from a polymer composition comprising a polymer comprising a polymer chain disrupter and a hydrophilic modifier;
b. collecting the scrim filaments 20 on a collection device 56 to form a scrim component (the second scrim component 18B as shown in FIG. 4);
c. unwinding a wet-laid fibrous structure 24 from a parent roll 58 on top of the second scrim component 18B;
d. forming a core component 12 of a coform fibrous structure 10 on top of the wet-laid fibrous structure 24 by spinning core filaments 16 from a die 54, for example a multi-row capillary die, from a polymer composition comprising a polymer, which may comprise a polymer chain disrupter and a hydrophilic modifier, into a coforming box 60 where solid additives 14, for example pulp fibers, via solid additive delivery source(s) 62 are commingled with the core filaments 16 (in this case the die 54, the solid additive delivery source(s) 62 and the coforming box 60 are connected to one another, for example without interruption of their respective walls, to form an enclosed volume except for the exit 64 where the commingled core filaments 16 and solid additives 14 exit the coforming box 60 and are deposited onto the wet-laid fibrous structure 24;
e. spinning another group of scrim filaments 20 via a die 54, for example a multi-row capillary die, from a polymer composition comprising a polymer, for example a polymer comprising a polymer chain disrupter and a hydrophilic modifier;
f. collecting the scrim filaments 20 from step e onto the core component 12 already present on the wet-laid fibrous structure 24, which is present on the second scrim component 18B riding on a collection device 56 to form a scrim component (the first scrim component 18A as shown in FIG. 4), which then ultimately forms a composite fibrous structure 22; and
g. passing the composite fibrous structure 22 through a bonding nip 66, for example heated steel rolls, for example a heated smooth steel roll 68A and a heated patterned steel roll 68B to bond the composite fibrous structure 22, which may produce a patterned composite fibrous structure 23 as shown for example in FIG. 6; and
h. optionally, winding the composite fibrous structure 22, which may be a patterned composite fibrous structure 23, into a roll 70.

Figure 7:
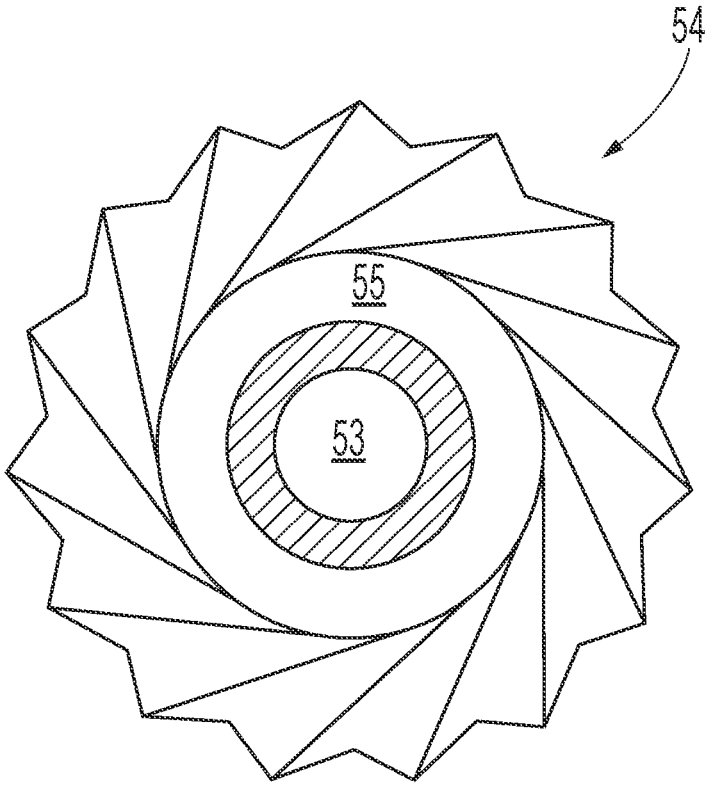
FIG. 7 is a schematic representation of an example of a filament-forming hole and fluid-releasing hole from a suitable die useful in making the core component and/or scrim component of the coform fibrous structure according to the present invention.

As shown in FIG. 7, one example of the die 54 comprises a plurality of filament-forming holes such as filament-forming hole 53 which is positioned within a fluid-releasing hole 55. The fluid-releasing hole 55 may be concentrically or substantially concentrically positioned around the filament-forming hole 53. In one example, the fluid, for example attenuation air, exits one of more, for example each fluid-releasing hole parallel or substantially parallel to the filament exiting the one or more filament-forming holes.

a. Wet-Laid Fibrous Structure

The wet-laid fibrous structure comprises a plurality of fibrous elements, for example a plurality of fibers. In one example, the wet-laid fibrous structure comprises a plurality of naturally-occurring fibers, for example pulp fibers, such as wood pulp fibers (hardwood and/or softwood pulp fibers). In another example, the wet-laid fibrous structure comprises a plurality of non-naturally occurring fibers (synthetic fibers), for example staple fibers, such as rayon, lyocell, polyester fibers, polycaprolactone fibers, polylactic acid fibers, polyhydroxyalkanoate fibers, and mixtures thereof.

The wet-laid fibrous structure of the present invention may be single-ply or multi-ply web material. In other words, the wet-laid fibrous structures of the present invention may comprise one or more wet-laid fibrous structures, the same or different from each other so long as one of them comprises a plurality of pulp fibers.

In one example, the wet-laid fibrous structure comprises a wet laid fibrous structure ply, such as a through-air-dried fibrous structure ply, for example an uncreped, through-air-dried fibrous structure ply and/or a creped, through-air-dried fibrous structure ply.

In another example, the wet-laid fibrous structure and/or wet laid fibrous structure ply may exhibit substantially uniform density.

In another example, the wet-laid fibrous structure and/or wet laid fibrous structure ply may comprise a surface comprising a surface pattern. In one example, the surface comprises one or more relatively high density regions and one or more relatively low density regions and/or wherein the surface pattern comprises one or more relatively high elevation regions and one or more relatively low elevation regions and/or wherein the surface pattern comprises one or more relatively high basis weight regions and one or more relatively low basis weight regions and/or wherein the surface pattern is a non-random, repeating pattern and/or wherein the surface pattern comprises a plurality of discrete regions (wherein at least a portion of the plurality of discrete regions exhibits a value of a common intensive property that is different from the value of the common intensive property exhibited by the continuous network) dispersed throughout a continuous network. The common intensive property may be selected from the group consisting of: density, bulk, basis weight, and mixtures thereof.

In one example, the wet laid fibrous structure ply comprises a conventional wet-pressed fibrous structure ply. The wet laid fibrous structure ply may comprise a fabric-creped fibrous structure ply. The wet laid fibrous structure ply may comprise a belt-creped fibrous structure ply.

In still another example, the wet-laid fibrous structure may comprise an air laid fibrous structure ply.

The wet-laid fibrous structures of the present invention may comprise a surface softening agent or be void of a surface softening agent, such as silicones, quaternary ammonium compounds, lotions, and mixtures thereof. In one example, the sanitary tissue product is a non-lotioned wet-laid fibrous structure.

The wet-laid fibrous structures of the present invention may comprise trichome fibers or may be void of trichome fibers.

The wet-laid fibrous structures of the present invention may comprise an absorbent gel material.

a. Patterned Molding Members

The wet-laid fibrous structures of the present invention may be formed on patterned molding members that result in the wet-laid fibrous structures of the present invention. In one example, the pattern molding member comprises a non-random repeating pattern. In another example, the pattern molding member comprises a resinous pattern.

In one example, the wet-laid fibrous structure comprises a textured surface. In another example, the wet-laid fibrous structure comprises a surface comprising a three-dimensional (3D) pattern, for example a 3D pattern imparted to the wet-laid fibrous structure by a patterned molding member. Non-limiting examples of suitable patterned molding members include patterned felts, patterned forming wires, patterned rolls, patterned fabrics, and patterned belts utilized in conventional wet-pressed papermaking processes, air-laid papermaking processes, and/or wet-laid papermaking processes that produce 3D patterned sanitary tissue products and/or 3D patterned fibrous structure plies employed in sanitary tissue products. Other non-limiting examples of such patterned molding members include through-air-drying fabrics and through-air-drying belts utilized in through-air-drying papermaking processes that produce through-air-dried fibrous structures, for example 3D patterned through-air dried fibrous structures, and/or through-air-dried sanitary tissue products comprising the wet-laid fibrous structure.

A "reinforcing element" may be a desirable (but not necessary) element in some examples of the molding member, serving primarily to provide or facilitate integrity, stability, and durability of the molding member comprising, for example, a resinous material. The reinforcing element can be fluid-permeable or partially fluid-permeable, may have a variety of embodiments and weave patterns, and may comprise a variety of materials, such as, for example, a plurality of interwoven yarns (including Jacquard-type and the like woven patterns), a felt, a plastic, other suitable synthetic material, or any combination thereof.

Non-limiting examples of patterned molding members suitable for use in the present invention comprises a through-air-drying belts. The through-air-drying belts may comprise a plurality of continuous knuckles, discrete knuckles, semi-continuous knuckles and/or continuous pillows, discrete pillows, and semi-continuous pillows formed by resin arranged in a non-random, repeating pattern supported on a support fabric comprising filaments, such as a forming fabric. The resin is patterned such that deflection conduits that contain little to know resin present in the pattern and result in the fibrous structure being formed on the patterned molding member having one or more pillow regions (low density regions) compared to the knuckle regions that are imparted to the fibrous structure by the resin areas.

b. Examples for Making Wet-Laid Fibrous Structures

In one non-limiting example, the wet-laid fibrous structure is made on a molding member of the present invention. The method may be a paper web, for example a fibrous structure making process that uses a cylindrical dryer such as a Yankee (a Yankee-process) (creped) or it may be a Yankeeless process (uncreped) as is used to make substantially uniform density and/or uncreped wet-laid fibrous structures (fibrous structures).

In one example, a process for making a paper web, for example a fibrous structure according to the present invention comprises supplying an aqueous dispersion of fibers (a fibrous or fiber furnish or fiber slurry) to a headbox which can be of any convenient design. From the headbox the aqueous dispersion of fibers is delivered to a first foraminous member (forming wire) which is typically a Fourdrinier wire, to produce an embryonic fibrous structure.

The embryonic fibrous structure is brought into contact with a patterned molding member, such as a 3D patterned through-air-drying belt. While in contact with the patterned molding member, the embryonic fibrous structure will be deflected, rearranged, and/or further dewatered. This can be accomplished by applying differential speeds and/or pressures.

After the embryonic fibrous structure has been associated with the patterned molding member, fibers within the embryonic fibrous structure are deflected into pillows ("deflection conduits") present in the patterned molding member. In one example of this process step, there is essentially no water removal from the embryonic fibrous structure through the deflection conduits after the embryonic fibrous structure has been associated with the patterned molding member but prior to the deflecting of the fibers into the deflection conduits. Further water removal from the embryonic fibrous structure can occur during and/or after the time the fibers are being deflected into the deflection conduits. Water removal from the embryonic fibrous structure may continue until the consistency of the embryonic fibrous structure associated with patterned molding member is increased to from about 25% to about 35%. Once this consistency of the embryonic fibrous structure is achieved, then the embryonic fibrous structure can be referred to as an intermediate fibrous structure. As noted, water removal occurs both during and after deflection; this water removal may result in a decrease in fiber mobility in the embryonic web material. This decrease in fiber mobility may tend to fix and/or freeze the fibers in place after they have been deflected and rearranged. Of course, the drying of the web material in a later step in the process of this invention serves to more firmly fix and/or freeze the fibers in position.

Any convenient means conventionally known in the papermaking art can be used to dry the intermediate fibrous structure. Examples of such suitable drying process include subjecting the intermediate fibrous structure to conventional and/or flow-through dryers and/or Yankee dryers.

In one example of a drying process, the intermediate fibrous structure may first pass through an optional predryer. This predryer can be a conventional flow-through dryer (hot air dryer) well known to those skilled in the art. Optionally, the predryer can be a so-called capillary dewatering apparatus. In such an apparatus, the intermediate fibrous structure passes over a sector of a cylinder having preferential-capillary-size pores through its cylindrical-shaped porous cover. Optionally, the predryer can be a combination capillary dewatering apparatus and flow-through dryer. The quantity of water removed in the predryer may be controlled so that a predried fibrous structure exiting the predryer has a consistency of from about 30% to about 98%. The predried fibrous structure may be applied to a surface of a Yankee dryer via a nip with pressure, the pattern formed by the top surface of patterned molding member is impressed into the predried web material to form a 3D patterned fibrous structure, for example a 3D patterned wet-laid fibrous structure of the present invention. The 3D patterned wet-laid fibrous structure is then adhered to the surface of the Yankee dryer where it can be dried to a consistency of at least about 95%.

The 3D patterned wet-laid fibrous structure can then be foreshortened by creping the 3D patterned wet-laid fibrous structure with a creping blade to remove the 3D patterned wet-laid fibrous structure from the surface of the Yankee dryer resulting in the production of a 3D patterned creped wet-laid fibrous structure in accordance with the present invention. As used herein, foreshortening refers to the reduction in length of a dry (having a consistency of at least about 90% and/or at least about 95%) web material which occurs when energy is applied to the dry web material in such a way that the length of the dry web material is reduced and the fibers in the dry web material are rearranged with an accompanying disruption of fiber-fiber bonds. Foreshortening can be accomplished in any of several well-known ways. One common method of foreshortening is creping. Another method of foreshortening that is used to make the wet-laid fibrous structures of the present invention is wet microcontraction. Further, the wet-laid fibrous structure may be subjected to post processing steps such as calendaring, tuft generating operations, and/or embossing and/or converting.

c. Non-limiting Example for Making a Wet-laid Fibrous Structure

A 20.0 gsm wet-laid fibrous structure ply is produced as follows. A cellulosic pulp fiber furnish consisting of about 63% refined softwood furnish consisting of about 76% Northern Bleached Softwood Kraft (Resolute), and 24% Southern Bleached Softwood Kraft (Alabama River Softwood); 12% unrefined softwood furnish consisting of about 85% Northern Bleached Softwood Kraft (Resolute), and 15% Southern Bleached Softwood Kraft (Alabama River Softwood); about 27% of unrefined hardwood Eucalyptus Bleached Kraft (Fibria); further furnish preparation and refining methodology common to the papermaking industry can be utilized.

A 3% active solution Kymene 5221 is added to the refined softwood line prior to an in-line static mixer and 1% active solution of Wickit 1285, an ethoxylated fatty alcohol available from Ashland Inc. is added to the unrefined Eucalyptus Bleached Kraft (Fibria) hardwood furnish. The addition levels are 21 and 1 lbs active/ton of paper, respectively.

The refined softwood and unrefined hardwood and unrefined NBSK/SSK/Eucalyptus bleached kraft/NDHK thick stocks are then blended into a single thick stock line followed by addition of 1% active carboxymethylcellulose (CMC-CALEXIS) solution at 7 lbs active/ton of paper towel, and optionally, a softening agent may be added.

The thick stock is then diluted with white water at the inlet of a fan pump to a consistency of about 0.15% based on total weight of softwood, hardwood and simulated broke fiber. The diluted fiber slurry is directed to a non-layered configuration headbox such that the wet web formed onto a Fourdrinier wire (foraminous wire). Optionally, a fines retention/drainage aid may be added to the outlet of the fan pump.

Dewatering occurs through the Fourdrinier wire and is assisted by deflector and vacuum boxes. The Fourdrinier wire is a 866A from AstenJohnson. (Legend 866A AJ-123) & dual layer construction, and wet microcontraction (WMC) of 2%, with a wire speed 765 fpm The embryonic wet web is transferred from the Fourdrinier wire at a fiber consistency of about 24% at the point of transfer, to a belt, such as a patterned belt through-air-drying resin carrying fabric. In the present case, the speed of the patterned through-air-drying fabric is approximately the same as the speed of the Fourdrinier wire. In another case, the embryonic wet web may be transferred to a patterned belt and/or fabric that is traveling slower, for example about 20% slower than the speed of the Fourdrinier wire (for example a wet molding process).

Further de-watering is accomplished by vacuum assisted drainage until the web has a fiber consistency of about 30%.

While remaining in contact with the patterned belt, the web is pre-dried by air blow-through pre-dryers to a fiber consistency of about 65% by weight.

After the pre-dryers, the semi-dry web is transferred to a Yankee dryer and adhered to the surface of the Yankee dryer with a sprayed creping adhesive. The creping adhesive is an aqueous dispersion with the actives consisting of about 75% polyvinyl alcohol, and about 25% CREPETROL® 5688. Optionally a crepe aid consisting of CREPETROL® A3025 may be applied. CREPETROL® R6390 and CREPETROL® A3025 are commercially available from Ashland Inc. (formerly Hercules Inc.). The creping adhesive diluted to about 0.15% adhesive solids and delivered to the Yankee surface at a rate of about 2# adhesive solids based on the dry weight of the web. The fiber consistency is increased to about 97% before the web is dry creped from the Yankee with a doctor blade.

In the present case, the doctor blade has a bevel angle of about 45° and is positioned with respect to the Yankee dryer to provide an impact angle of about 101° and the reel is run at a speed that is about 15% faster than the speed of the Yankee. In another case, the doctor blade may have a bevel angle of about 25° and be positioned with respect to the Yankee dryer to provide an impact angle of about 81° and the reel is run at a speed that is about 15% slower than the speed of the Yankee. The Yankee dryer hood is operated at a temperature of about 450° F. and a speed of about 750 fpm.

The wet-laid fibrous structure is wound in a roll using a surface driven reel drum having a surface speed of about 638 feet per minute.

d. Non-Limiting Example for Making a Composite Fibrous Structure

A 2.0 gsm scrim component (second scrim component) comprising meltblown filaments (scrim filaments) is laid down upon a collection device, for example an Albany International Velostat170pc740 belt ("forming fabric"), (available from Albany International, Rochester, NH) traveling at 556 ft/min. The meltblown filaments of the scrim components are comprised of a blend of 42.8% LyondellBasell MF650x (polypropylene), 25% LyondellBasell MF650w (polypropylene), 15.2% Total 3866 (polypropylene), 5% Polyvel VW351 (hydrophilic modifier), 2% Ampacet 412951 (opacifier), and 10% Vistamaxx 7050FL (polymer chain disrupter) and are spun from a die, for example a multi-row capillary Biax-Fiberfilm die (Biax-Fiberfilm Corporation, Greenville, WI), at a mass flow of 126.7 g/min and a ghm of 0.206 and is attenuated with 14.82 kg/min of 204° C. (400° F.) air and quenched with two external mix, air atomized quench nozzle delivery 25 L/hr of water using 0.25 kg/min of atomization air.

Next, a 20 gsm wet-laid fibrous structure made as described in the previous section, is placed upon a surface of the second scrim component as the second scrim component is carried by the collection device. In one example, the wet-laid fibrous structure is unwound from a parent roll.

Then, a core component (5.6 gsm pulp fibers/2.0 gsm filaments) of a coform fibrous structure is directly formed on a surface of the wet-laid fibrous structure as the wet-laid fibrous structure/second scrim component composite is carried on the collection device. The core component is formed as follows: solid additives, for example fibers, in this case pulp fibers, namely, 490 grams per minute of Resolute CoosAbsorbST semi-treated SSK, are fed into a hammer mill and individualized into fibers, for example cellulose pulp fibers, which are pneumatically conveyed into a coforming box, example of which is described in U.S. Patent Publication No. US 2016/0355950A1 filed Dec. 16, 2015, which is incorporated herein by reference. In the coforming box, the fibers, for example pulp fibers, are commingled with meltblown filaments (core filaments). The meltblown filaments are comprised of a blend of 45.4% LyondellBasell MF650x (polypropylene), 26.5% LyondellBasell MF650w (polypropylene), 16.1% Total 3866 (polypropylene), 5% Polyvel VW351 (hydrophilic modifier), 2% Ampacet 412951 (opacifier), and 5% Vistamaxx 7050FL (polymer chain disrupter). The meltblown filaments are spun from a die, for example a multi-row capillary Biax-Fiberfilm die, at a ghm of 0.206 and a total mass flow of 126.7 g/min. The meltblown filaments are attenuated with 15.65 kg/min of about 204° C. (400° F.) air. The mixture (commingled) fibers, for example cellulose pulp fibers and meltblown filaments are then laid on top of the already formed 1.0 gsm scrim component to form the coform fibrous structure.

Then another scrim component, in this case a first scrim component is added to the top of the non-scrimmed side of the core component (the top side of the coform fibrous structure formed immediately above). This first scrim component is a 1.6 gsm scrim component comprising meltblown filaments comprised of a blend of 45.4% LyondellBasell MF650x (polypropylene), 26.5% LyondellBasell MF650w (polypropylene), 16.1% Total 3866 (polypropylene), 5% Polyvel VW351 (hydrophilic modifier), 2% Ampacet 412951 (opacifier), and 5% Vistamaxx 7050FL (polymer chain disrupter) that are spun from a die, for example a multi-row capillary Biax-Fiberfilm die, at a ghm of 0.165 and a total mass flow of 101.6 g/min. The meltblown filaments are attenuated with 16.3 kg/min of about 204° C. (400° F.) air and are laid down on top of the core component of the coform fibrous structure such that the core component is positioned between the wet-laid fibrous structure and the first scrim component. The composite fibrous structure may then be passed through a bonding nip, for example formed by two steel heated rolls to bond and/or consolidate the composite fibrous structure.

Absorbent Article

An absorbent article, for example a non-elastic absorbent article, of the present invention comprises one or more and/or two or more and/or three or more and/or four or more fibrous webs (fibrous web plies), which comprise one or more fibrous structures at least one of which is a coform fibrous structure, for example a non-elastic coform fibrous structure according to the present invention.

In one example of the present invention, the absorbent article, for example a non-elastic absorbent article, for example a non-elastic sanitary tissue product, such as a non-elastic paper towel, exhibits very high absorbencies without compromising softness of the absorbent article. This is achieved partly by the inclusion of a composite fibrous structure of the present invention being included in the absorbent article. To allow for high absorbencies, wet-laid fibrous structure making process choices such as fiber furnish mix, fiber refining levels, and molding member, for example belt design upon which the wet-laid fibrous structure is formed, can be chosen to create a lofty, high absorbent capacity wet-laid fibrous structure that is soft and low in strength. The filaments, for example polypropylene filaments, present in the coform fibrous structure are relied upon to deliver the strength of the absorbent article, while still being soft and/or flexible and/or non-stiff both wet and dry. Additionally, the interspersion of fibers, for example pulp fibers, with the filaments within the coform fibrous structure adds to the soft, velvet-like hand feel of the article.

In another example of the present invention, the absorbent article, for example a non-elastic absorbent article, for example a non-elastic sanitary tissue product, such as a non-elastic paper towel, exhibits very high absorbencies without compromising strength of the absorbent article. This is achieved partly by the inclusion of a composite fibrous structure of the present invention being included in the absorbent article. To allow for high absorbencies, wet-laid fibrous structure making process choices such as fiber furnish mix, fiber refining levels, and molding member, for example belt design upon which the wet-laid fibrous structure is formed, can be chosen to create a lofty, high absorbent capacity wet-laid fibrous structure that is soft and low in strength. The filaments, for example polypropylene filaments, present in the coform fibrous structure are relied upon to deliver the strength of the absorbent article, while still being soft and/or flexible and/or non-stiff both wet and dry. Additionally, the interspersion of fibers, for example pulp fibers, with the filaments within the coform fibrous structure adds to the soft, velvet-like hand feel of the article.

Figure 8:
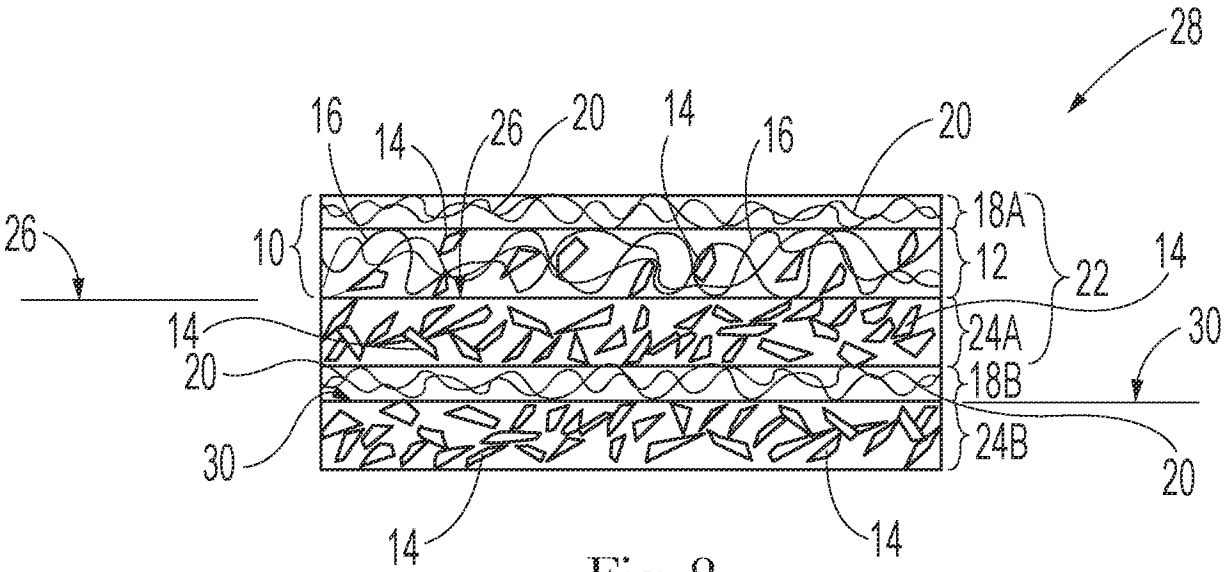
FIG. 8 is a schematic representation of an example of an absorbent article according to the present invention.

As shown in FIG. 8, an example of an absorbent article 28 of the present invention, for example a paper towel, comprises a composite fibrous structure 22, which may be a patterned composite fibrous structure 23 as shown in FIG. 6, comprising a coform fibrous structure 10 and a first wet-laid fibrous structure ply 24A as described herein that is associated with, directly or indirectly via a second scrim component 18B, for example bonded to via thermal bonds, a second wet-laid fibrous structure ply 24B.

In one example as shown in FIGS. 9A-9D, an absorbent article 28 of the present invention is made by supplying a composite fibrous structure 22, for example a patterned composite fibrous structure 23, for example by unwinding a roll 70 of composite fibrous structure 22, and passing it through an embossing nip 72, for example a high definition embossing nip, which in one example results in embossments that exhibit an embossment height of greater than 0.60 mm.

The embossing nip 72 may be formed from a first embossing roll 74 and a second embossing roll 76. It should be noted that the embodiments shown in the figures are just exemplary embodiments and other embodiments are certainly contemplated. For example, the embossing rolls 74 and 76 of the embodiment shown in FIGS. 9B and 9D could be replaced with any other embossing members such as, for example, plates, cylinders or other equipment suitable for embossing fibrous structure plies and/or fibrous structure webs. Further, additional equipment and steps that are not specifically described herein may be added to the embossing step and/or process of the present invention. The embossing rolls 74 and 76 are disposed adjacent to each other to provide the embossing nip 72. The embossing rolls 74 and 76 are generally configured so as to be rotatable on an axis, the axes of the embossing rolls 74 and 76 are typically generally parallel to one another. The embossing rolls 74 and 76 may be contained within a typical embossing device housing.

Figures 9A, 9B:
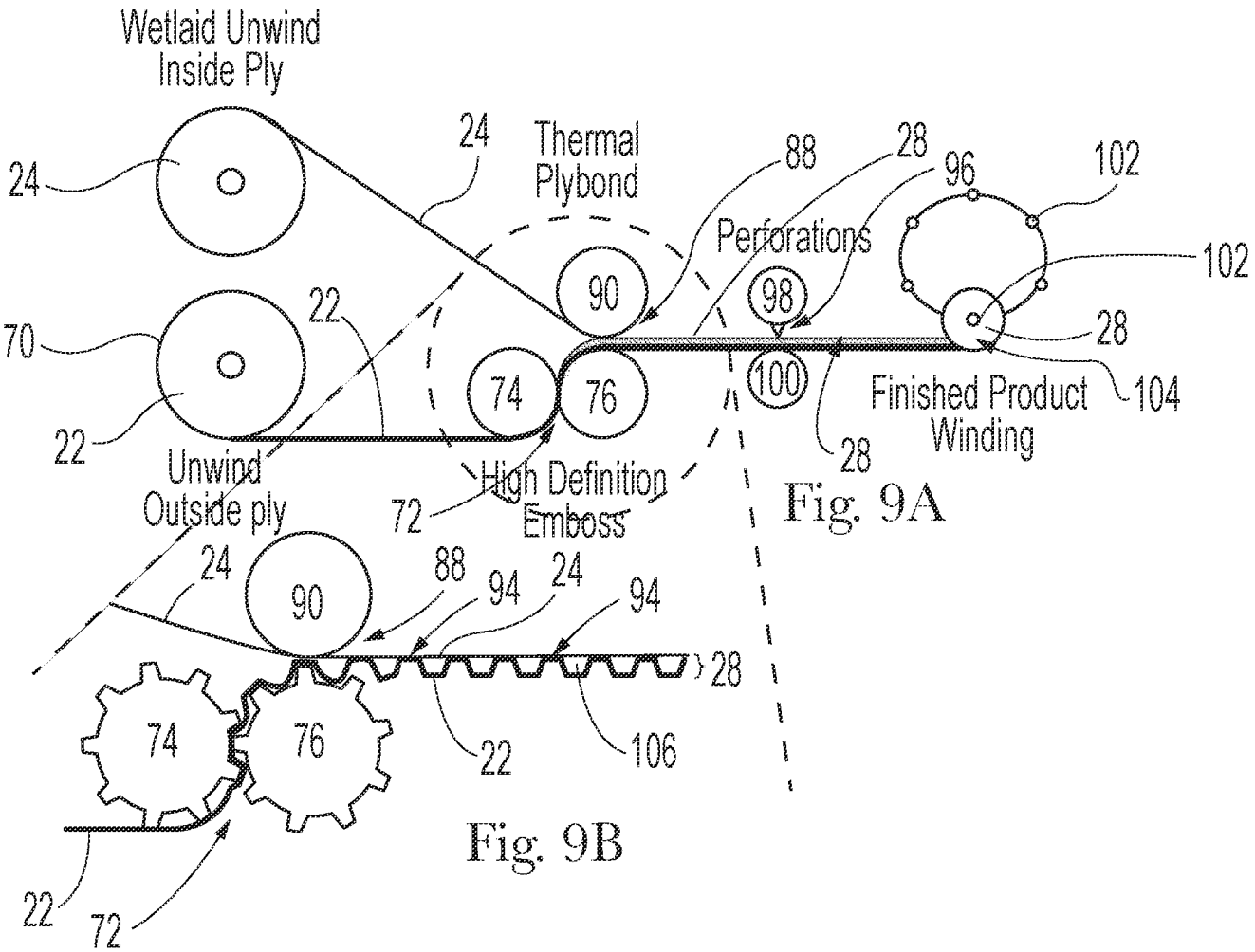
FIG. 9A is a schematic representation of an example of a method for making an absorbent article according to the present invention.
FIG. 9B is an enlarged, detailed view of the embossing nip and bonding nip of FIG. 9A.
Figure 9C:
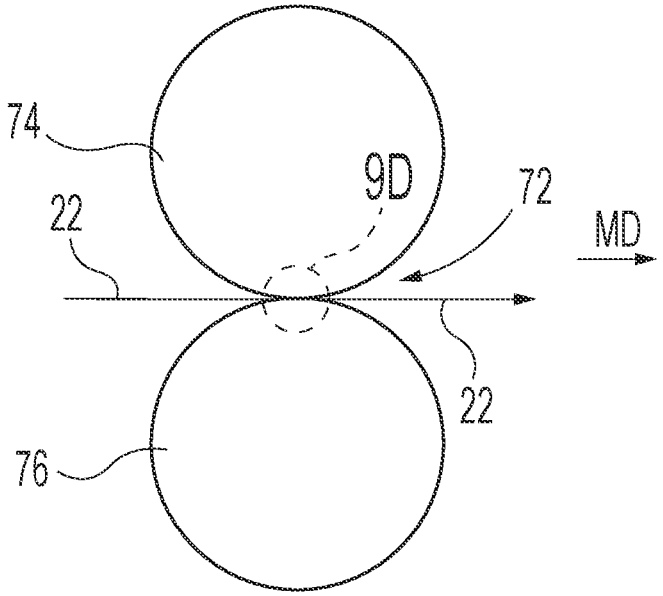
FIG. 9C is a schematic representation of the embossing nip of FIG. 9A.
Figure 9D:
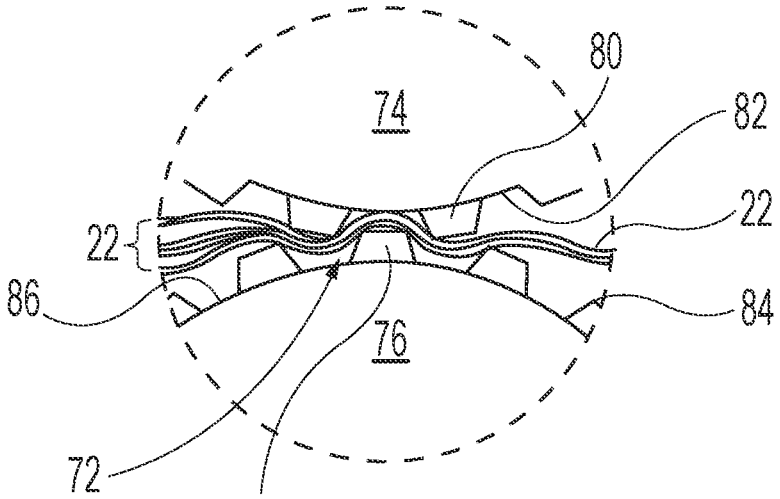
FIG. 9D is an enlarged, detailed view of the embossing nip of FIG. 9C.

FIG. 9D is an enlarged view of the portion of the embossing nip 72 labeled 9D in FIG. 9C. FIG. 9D shows a more detailed view of the ply of composite fibrous structure 22 passing through the embossing nip 72 between the embossing rolls 74 and 76. As can be seen in FIG. 9D, the first embossing roll 74 includes a plurality of first embossing protrusions 80 extending from the outer surface 82 of the first embossing roll 74. The second embossing roll 76 includes a plurality of second embossing protrusions 84 extending outwardly from the outer surface 86 of the second embossing roll 76. The first embossing protrusions 80 and the second embossing protrusions 84 are generally arranged in a non-random pattern. (It should be noted that when the embossing protrusions 80 and/or 84 are described as extending from an outer surface of an embossing roll, the embossing protrusions may be integral with the surface of the embossing roll and/or may be separate protrusions that are joined to the surface of the embossing roll.) As the ply of composite fibrous structure 22 is passed through the embossing nip 72, it is nested and macroscopically deformed by the intermeshing of the first embossing protrusions 80 and the second embossing protrusions 84. The embossing shown is deep-nested embossing, as described herein, because the first embossing protrusions 80 and the second embossing protrusions 84 intermesh with each other, for example like the teeth of gears. Thus, the resulting embossed composite fibrous structure 22 is deeply embossed and nested and includes a plurality of undulations that can add bulk and caliper to the embossed composite fibrous structure ply 22.

The embossing rolls 74 and 76, including the outer surfaces of the rolls 82 and 86, respectively, as well as the embossing protrusions 80 and 84, may be made out of any material suitable for the desired embossing process. Such materials include, without limitation, steel and other metals, ebonite, and hard rubber or a combination thereof. In addition any of the components of the embossing rolls 74 and 76 (embossing protrusions 80 and 84 and outer surfaces 82 and 86, respectively) can be heated to facilitate softening of the composite fibrous structure ply 22 an d/or thermal bonding within the composite fibrous structure ply 22 to create thermal bonds, in this case water-resistant bonds, for example thermal bonds and/or water-resistant adhesive bonds.

Figure 10A:
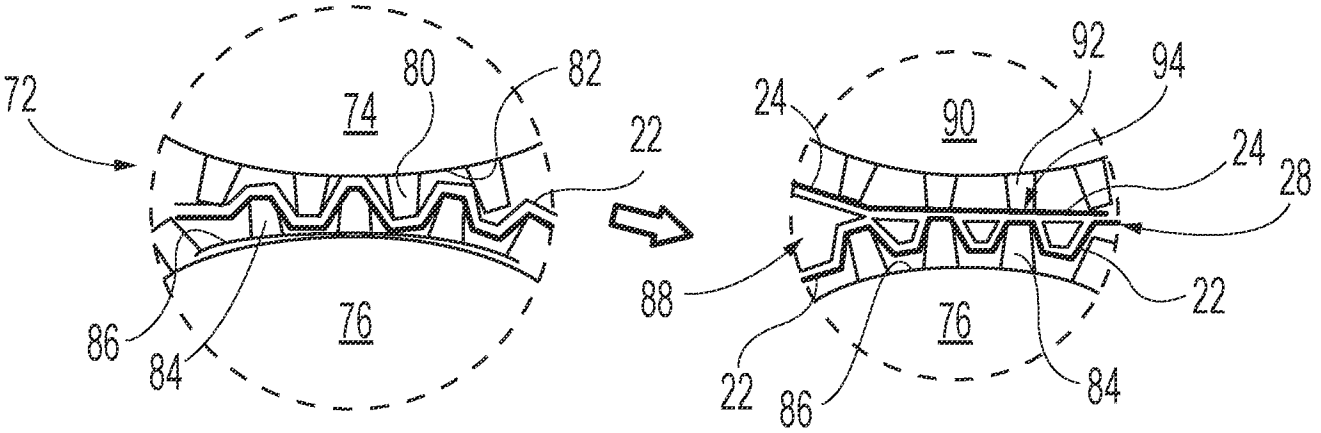
FIG. 10A is an enlarged, detailed view of the embossing nip and bonding nip of FIG. 9A.
Figure 10B:
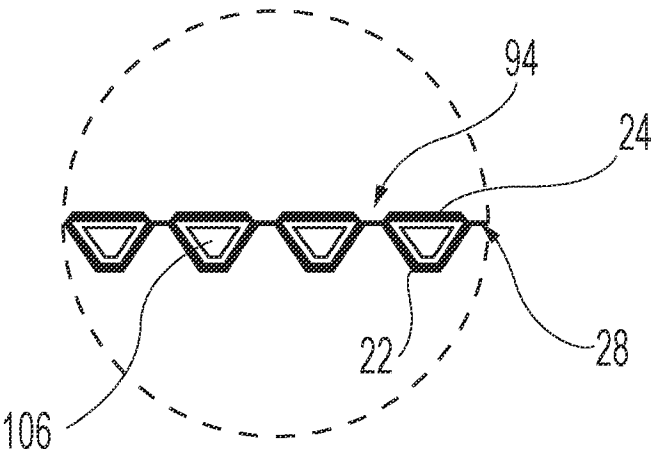
FIG. 10B is an enlarged, detailed view of an absorbent article made via the embossing nip and bonding nip of FIG. 10A.

As shown in FIGS. 9A-9B and 10A-10B, after the composite fibrous structure ply 22 has passed through the embossing nip 72 and while the embossed composite fibrous structure ply 22 is still in contact with the embossing roll 76, the embossed composite fibrous structure ply 22 is combined (married) with a wet-laid fibrous structure ply 24. The embossed composite fibrous structure ply 22 and the wet-laid fibrous structure ply 24 are combined together as they contact one another while passing through a bonding nip 88, for example a thermal bonding nip, formed by embossing roll 76 and thermal bond roll 90 having a thermal bond roll protrusion 92 that bonds the embossed composite fibrous structure ply 22 and the wet-laid fibrous structure 24 together via bonds 94, for example water-resistant bonds such as thermal bonds, to form an absorbent article 28 as shown in FIG. 10B.

Figure 11A:
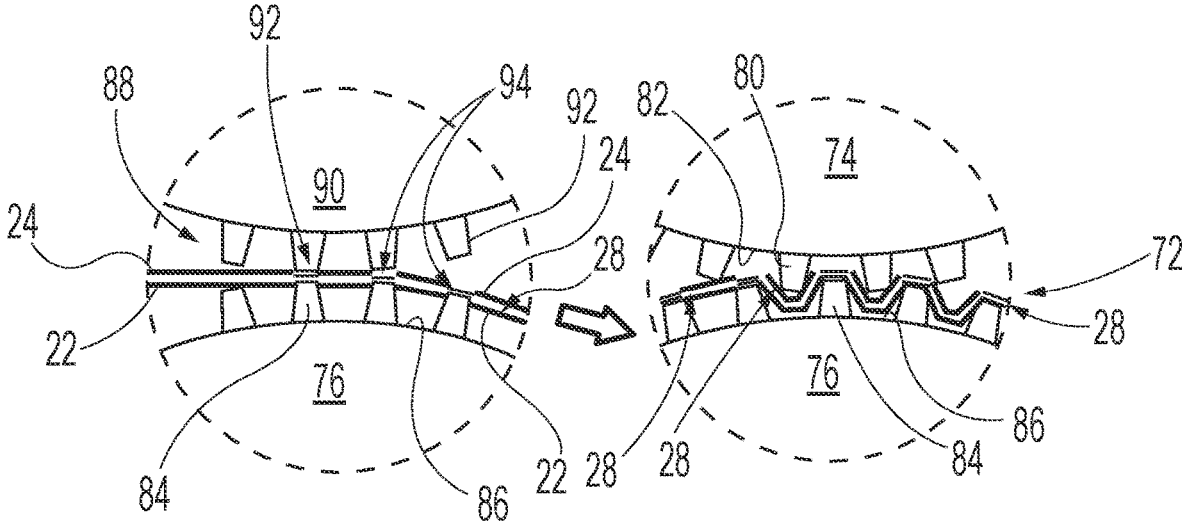
FIG. 11A is an enlarged, detailed view of an example of another combining nip and embossing nip that could be used in a method according to the present invention.
Figure 11B:
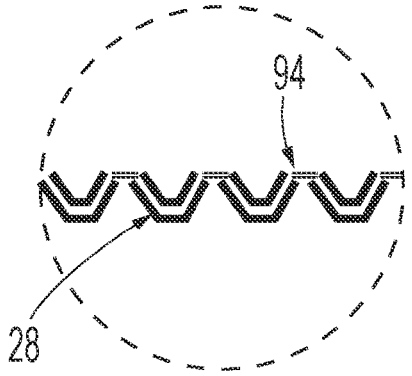
FIG. 11B is an enlarged, detailed view of an absorbent article made via the bonding nip and embossing nip of FIG. 11A.

In another example as shown in FIGS. 11A and 11B, the composite fibrous structure ply 22 and the wet-laid fibrous structure ply 24 may be combined together via a bonding nip 88 to form the absorbent article 28 and then subsequently passing the absorbent article 28 through the embossing nip 72.

Figure 12A:
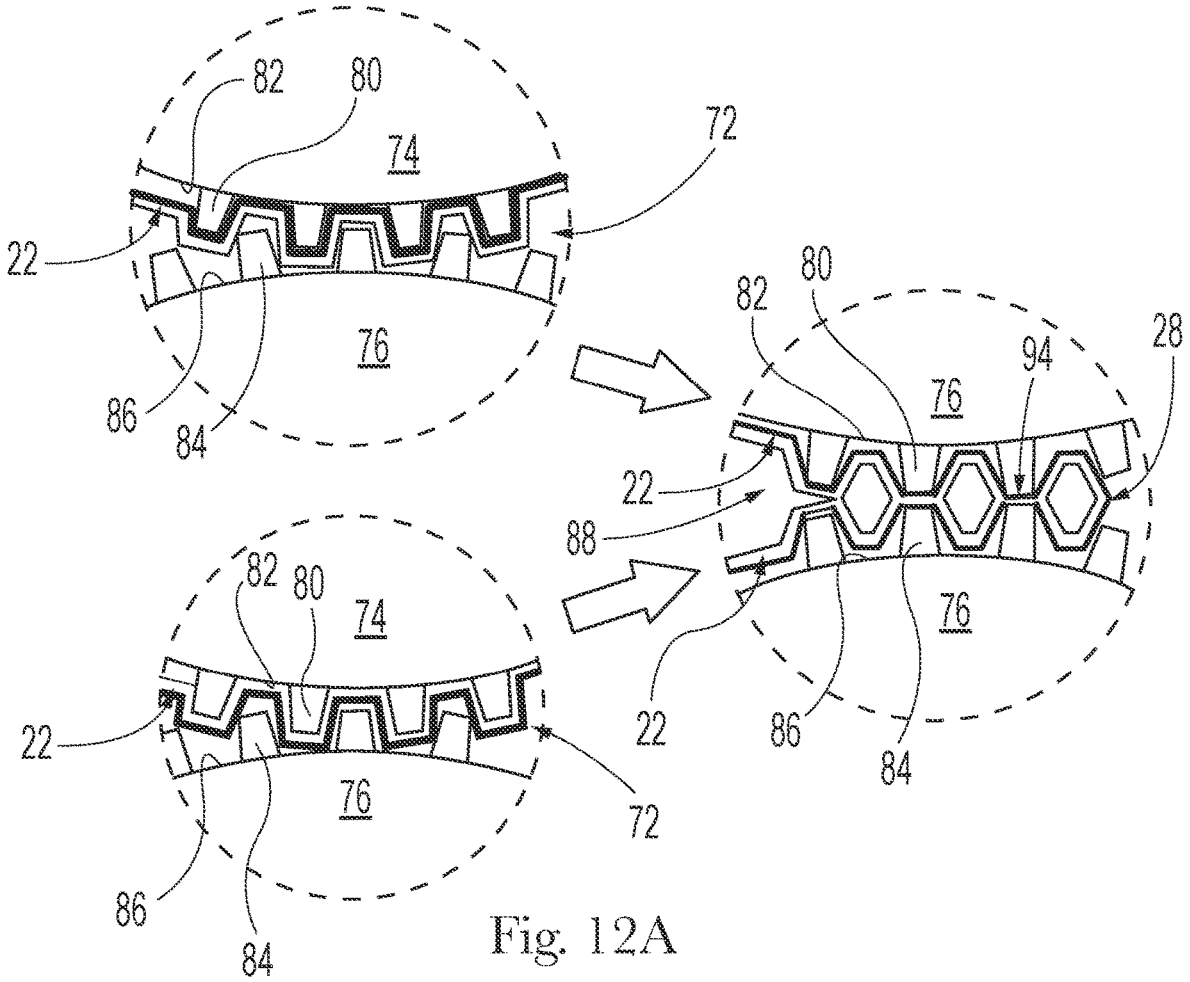
FIG. 12A is an enlarged, detailed view of an example of another two embossing nips and a bonding nip that could be used in a method according to the present invention.
Figure 12B:
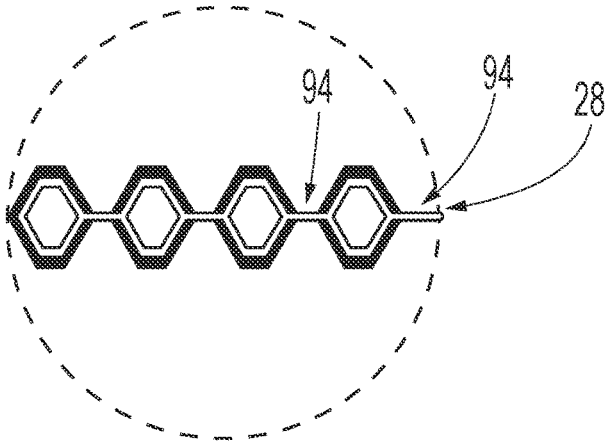
FIG. 12B is an enlarged, detailed view of an absorbent article made via the two embossing nips and the bonding nip of FIG. 12A.
Figure 13:
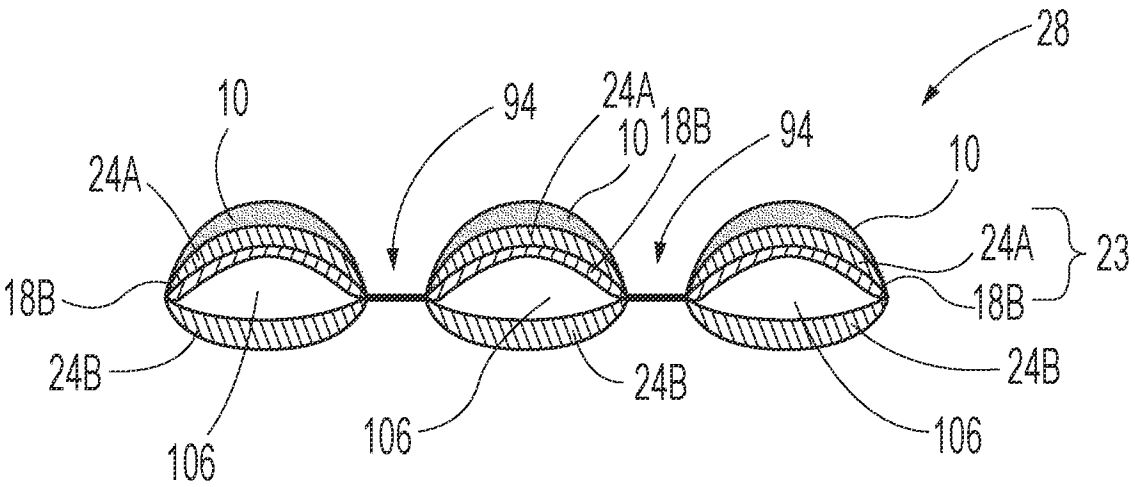
FIG. 13 is an enlarged, detailed view of an absorbent article made according to the method of FIG. 9A.
Figure 14:
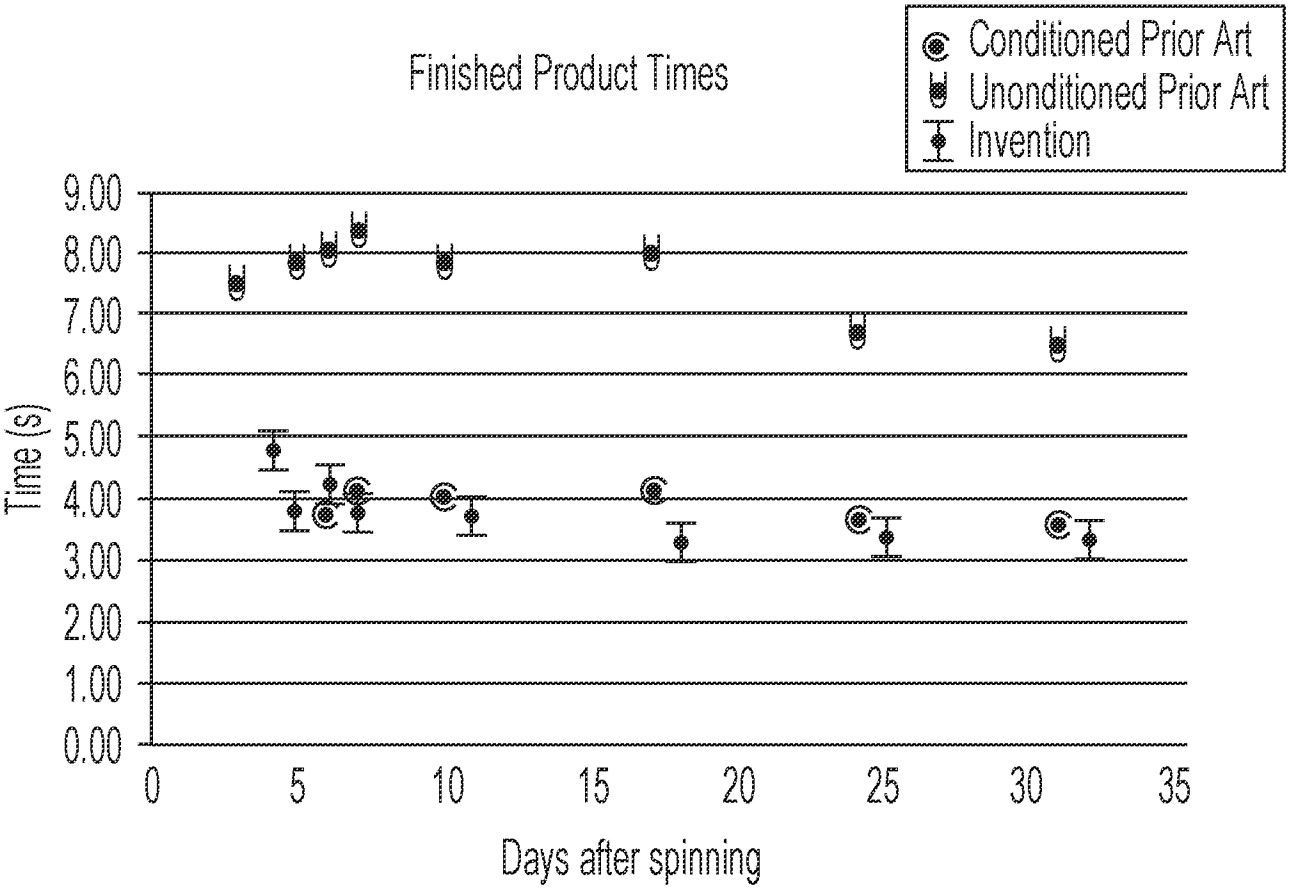
FIG. 14 is a graph of Pad Sink Times as measured according to the Pad Sink Test Method.

In yet another example as shown in FIGS. 12A-12B, two fibrous structure plies, for example two composite fibrous structure plies 22 or a composite fibrous structure ply 22 and a wet-laid fibrous structure ply 24 (not shown), my each be embossed prior to combining together. In this case, a first composite fibrous structure ply 22 and a second composite fibrous structure ply 22 are each individually embossed by passing through separate embossing nips 72. After embossing, the two embossed composite fibrous structure plies 22 are combined together in a bonding nip 88 formed by the embossing rolls 76 to form the absorbent article 28. As shown in FIG. 13, the resulting absorbent article 28, which is similar to the absorbent article 28 shown in FIG. 8 with the exception that the composite fibrous structure 22 (in this case described in FIG. 3) has been embossed to form an embossed composite fibrous structure 23 before combining with an additional wet-laid fibrous structure 24B such that void volumes (pockets) 106 are formed between the two fibrous structure plies.

As shown in FIG. 9A, after the absorbent article 28 has been formed, the absorbent article may be subjected to a perforation step via a perforation nip 96 formed by an anvil roll 98 and a blade roll 100.

The absorbent article 28 may then be wound via a reel about a core 102 to make a roll 104 of finished product (absorent article, for example a 2-ply paper towel according to the present invention).

a. Non-Limiting Example for Making an Absorbent Article (2-Ply Paper Towel)

A roll of composite fibrous structure as made above and a roll of wet-laid fibrous structure are placed on unwind stands and unwound while tensioning in such a manner that the plies of the composite fibrous structure and the wet-laid fibrous structure are neither overly strained to cause excessive neckdown nor under strained to cause wrinkles or edge defects. This tension is maintained throughout the process by using a series of driven rolls and idlers. The composite fibrous structure ply is metered to a high definition emboss (HDE) unit and drawn through the HDE unit's HDE nip as shown in FIGS. 8A and 8B, which in this example is comprised of two mated steel rolls that have 0.120" tall metal protrusions. The design of these protrusions is such that the surface of the rolls can interfere without the protrusions touching each other until they bottom out with a 0.120" interference. The composite fibrous structure ply, when passed through the HDE nip, is sufficiently strained due to the interference, spacing and number of the protrusions, to impart a significant increase in caliper to the thickness of the composite fibrous structure ply and retains the general shape of the protrusions. The composite fibrous structure ply exits the HDE nip while adhering to the protrusions on one of the two steel rolls that formed the HDE nip. The composite fibrous structure ply is then combined on the same steel roll while adhered to the protrusions with the wet-laid fibrous structure ply that does not pass through an HDE nip and that is unwound and tensioned as previously described with regard to the composite fibrous structure ply. The wet-laid fibrous structure ply bypasses the HDE nip and is then combined with the composite fibrous structure ply with the use of a third roll that creates a thermal bond nip with the steel roll the composite fibrous structure ply is adhered to, when pressed with sufficient force and heated to a certain temperature, causes the composite fibrous structure ply and the wet-laid fibrous structure ply to bond sufficiently together, while the composite fibrous structure ply is adhered to the steel roll. The third roll is a smooth metal roll, which is heated to result in a water-resistant bond, for example a thermal bond, being formed between the composite fibrous structure ply and the wet-laid fibrous structure ply at numerous areas and creates void volumes between the combined plies. The interference between the mated steel rolls forming the HDE nip is about 0.080" but can be run as high as 0.120" at which the emboss protrusions from each roll bottom out on the opposing mated steel roll. The mated steel rolls, which are in surface contact with the composite fibrous structure ply, are typically run at similar temperatures which are bounded by the melt temperatures of the polymer. Target surface temperature of between (120° C.-130° C.) (250° F.-265° F.) are often run on the mated steel rolls. The surface temperature of the smooth metal roll is run between (215° C.-221° C.) (420° F.-430° F.) temperature. The wet-laid fibrous structure ply contacts this hotter roll and shields the composite fibrous structure ply from the higher roll temperatures when the line is in operation. Higher temperature on the smooth metal roll improves thermal bond strength. The pressure run in the thermal bond nip is about 150 ph. Without wishing to be bound by theory, it is believed that the combination of temperature and pressure softens the polymer filaments of the composite fibrous structure ply and allows the polymer to flow around the wet-laid fibrous structure ply and forms a bond as it cools and sets. After exiting the thermal bond nip, the 2-ply fibrous structure is now a consolidated 2-ply fibrous structure, which is tensioned using driven rolls and idlers, that neither over strain the 2-ply fibrous structure to cause excessive neckdown, nor under strain the 2-ply fibrous structure to cause web handling control issues. The 2-ply fibrous structure is then perforated to a sheet length typically between 3" and 11" inches while using rotating anvil and blade rolls and finally wound to a finished product roll diameter target typically between 4" and 7" using center, surface or hybrid winding mechanisms, resulting in the absorbent article (2-ply paper towel).

In one example, the absorbent articles, for example sanitary tissue products such as paper towels especially non-elastic paper towels, of the present invention exhibit fresh, immediate (less than 30 days and/or less than 25 days and/or less than 20 days and/or less than 15 days and/or less than 10 days and/or less than 5 days and/or less than 3 days after production (spinning of the fibrous elements)) without subjecting the absorbent articles to 50° C. or greater and relative humidity of 60% or greater Pad Sink Times as measured by the Pad Sink Test Method described herein of less than 6.0 seconds and/or less than 5.5 seconds and/or less than 5.0 second and/or less than 4.5 seconds and/or less than 4.0 second and/or about or greater than 0 seconds.

Table 1 below shows Pad Sink Times as measured according to the Pad Sink Test Method described herein for an inventive absorbent article (2-ply paper towel) according to the present invention made as described above in a. ("Inventive Absorbent Article") compared to two prior art absorbent articles made as generally described above in a. except neither contains a polymer chain disrupter ("Prior Art Unconditioned Absorbent Article" and "Prior Art Conditioned Absorbent Article") and only one has been subjected to 50° C. or greater and relative humidity of 60% or greater for at least 48 hours ("Prior Art Conditioned Absorbent Article").

TABLE 1

| Days After Production (Spinning of the Fibrous Elements) | Inventive Absorbent Article (seconds) | Prior Art Unconditioned Absorbent Article (seconds) | Prior Art Conditioned Absorbent Article (seconds) |
|---|---|---|---|
| 3 | — | 7.4 | — |
| 4 | 4.8 | — | — |
| 5 | 3.8 | 7.8 | 3.8 |
| 6 | 4.2 | 7.9 | 3.9 |
| 7 | 3.9 | 8.3 | 4.0 |
| 10 | — | 7.8 | 4.0 |
| 11 | 3.7 | — | — |
| 17 | — | 8.0 | 4.1 |

TABLE 1-continued

| Days After Production (Spinning of the Fibrous Elements) | Inventive Absorbent Article (seconds) | Prior Art Unconditioned Absorbent Article (seconds) | Prior Art Conditioned Absorbent Article (seconds) |
|---|---|---|---|
| 18 | 3.2 | — | — |
| 24 | — | 6.7 | 3.6 |
| 25 | 3.4 | — | — |
| 31 | — | 6.5 | 3.6 |
| 32 | 3.4 | — | — |

In addition to the Pad Sink Test suitable for measuring Pad Sink Times for absorbent articles, certain components, for example the composite fibrous structure of the absorbent articles may exhibit Phink Times as measured according to the Phink Test Method described herein of less than 40 seconds and/or less than 30 seconds and/or less than 25 seconds and/or less than 20 seconds and/or less than 15 seconds and/or less than 12 seconds and/or less than 7 seconds and/or less than 4 seconds and/or about or greater than 0 seconds.

Table 2 below shows Phink Times as measured according to the Phink Test Method described herein for two inventive composite fibrous structure according to the present invention generally made as described above in Composite Fibrous Structure (d) ("Inventive Composite Fibrous Structure 1" and "Inventive Composite Fibrous Structure 2", which has a higher wet burst wet-laid fibrous structure) compared to a prior art Composite Fibrous Structure made as generally described above in Composite Fibrous Structure (d) except the prior art Composite Fibrous Structure does not contain a polymer chain disrupter ("Prior Art Composite Fibrous Structure").

TABLE 2

| Composite Fibrous Structure | Average Phink Time (seconds) |
|---|---|
| Inventive Composite Fibrous Structure 1 | 11.58 |
| Inventive Composite Fibrous Structure 2 | 2.17 |
| Prior Art Composite Fibrous Structure | 54.83 |

Test Methods

Unless otherwise specified, all tests described herein including those described under the Definitions section and the following test methods are conducted on samples that have been conditioned in a conditioned room at a temperature of 23° C.±1.0° C. and a relative humidity of 50%±2% for a minimum of 24 hours prior to the test. These will be considered standard conditioning temperature and humidity. All plastic and paper board packaging articles of manufacture, if any, must be carefully removed from the samples prior to testing. The samples tested are "usable units." "Usable units" as used herein means sheets, flats from roll stock, pre-converted flats, fibrous structure, and/or single or multi-ply products. Except where noted all tests are conducted in such conditioned room, under the same environmental conditions in such conditioned room. Discard any damaged product. Do not test samples that have defects such as wrinkles, tears, holes, and like. All instruments are calibrated according to manufacturer's specifications. The stated number of replicate samples to be tested is the minimum number.

Basis Weight Test Method

Basis weight of an absorbent article and/or composite fibrous structure and/or coform fibrous structure is measured on stacks of eight to twelve usable units using a top loading analytical balance with a resolution of ±0.001 g. A precision cutting die, measuring 8.890 cm by 8.890 cm or 10.16 cm by 10.16 cm is used to prepare all samples.

Condition samples under the standard conditioning temperature and humidity for a minimum of 10 minutes prior to cutting the sample. With a precision cutting die, cut the samples into squares. Combine the cut squares to form a stack eight to twelve samples thick. Measure the mass of the sample stack and record the result to the nearest 0.001 g. Calculations:

$$\text{Basis Weight, g/m}^2 = \frac{\text{mass of stack}}{\text{(area of 1 square in stack)(\# squares in stack)}}$$

Report result to the nearest 0.1 g/m$^2$. Sample dimensions can be changed or varied using a similar precision cutter as mentioned above, so as at least 645 square centimeters of sample area is in the stack.

Individual fibrous structures and/or fibrous webs that are ultimately combined to form and article may be collected during their respective making operation prior to combining with other fibrous web and/or fibrous structures and then the basis weight of the respective fibrous web and/or fibrous structure is measured as outlined above.

Average Diameter Test Method

There are many ways to measure the diameter of a fiber. One way is by optical measurement. An article and/or fibrous web and/or fibrous structure comprising filaments is cut into a rectangular shape sample, approximately 20 mm by 35 mm. The sample is then coated using a SEM sputter coater (EMS Inc, PA, USA) with gold so as to make the filaments relatively opaque. Typical coating thickness is between 50 and 250 nm. The sample is then mounted between two standard microscope slides and compressed together using small binder clips. The sample is imaged using a 10× objective on an Olympus BHS microscope with the microscope light-collimating lens moved as far from the objective lens as possible. Images are captured using a Nikon D1 digital camera. A Glass microscope micrometer is used to calibrate the spatial distances of the images. The approximate resolution of the images is 1 μm/pixel. Images will typically show a distinct bimodal distribution in the intensity histogram corresponding to the filaments and the background. Camera adjustments or different basis weights are used to achieve an acceptable bimodal distribution. Typically 10 images per sample are taken and the image analysis results averaged.

The images are analyzed in a similar manner to that described by B. Pourdeyhimi, R. and R. Dent in "Measuring fiber diameter distribution in nonwovens" (Textile Res. J. 69(4) 233-236, 1999). Digital images are analyzed by computer using the MATLAB (Version. 6.1) and the MATLAB Image Processing Tool Box (Version 3.) The image is first converted into a grayscale. The image is then binarized into black and white pixels using a threshold value that minimizes the intraclass variance of the thresholded black and white pixels. Once the image has been binarized, the image is skeletonized to locate the center of each fiber in the image. The distance transform of the binarized image is also computed. The scalar product of the skeletonized image and the distance map provides an image whose pixel intensity is either zero or the radius of the fiber at that location. Pixels within one radius of the junction between two overlapping fibers are not counted if the distance they represent is smaller than the radius of the junction. The remaining pixels are then used to compute a length-weighted histogram of filament diameters contained in the image.

Contact Angle Test Method

In order to prepare the samples (fibrous structures and/or fibrous elements) for contact angle measurement, the samples must be conditioned. The samples must be washed 3 times with distilled water. The samples are air dried and conditioned at a temperature of 23° C.±1.0° C. and a relative humidity of 50%±2% for a minimum of 2 hours. The samples are tested in the conditioned room described above It is important to not permit the conditioned samples to be subjected to greater than 100° F. at a relative humidity of less than 60% prior to measuring the contact angle. To conduct the contact angle test, 5-7 μL of Millipore purified water is deposited on to the sample. High speed video imaging at 120 frames per second is used to capture the contact and wetting of the drop on the sample. The contact angle measurement is taken on the second frame after detachment of the drop using First Ten Angstroms software available from First Ten Angstroms, Inc. of Portsmouth, Va. Or its equivalent.

Pad Sink Test Method

This Pad Sink Test Method is used to determine rate of water absorption of finished (converted) fibrous structures, for example paper towel products, for example paper towel products comprising a composite fibrous structure comprising a wet-laid fibrous structure and a coform fibrous structure and optionally an additional composite fibrous structure ply and/or an additional fibrous structure ply, for example another wet-laid fibrous structure.

The test is conducted in a conditioned room with a temperature of 23° C.±1° C. and a relative humidity of 50%±2%.

Figure 15A:
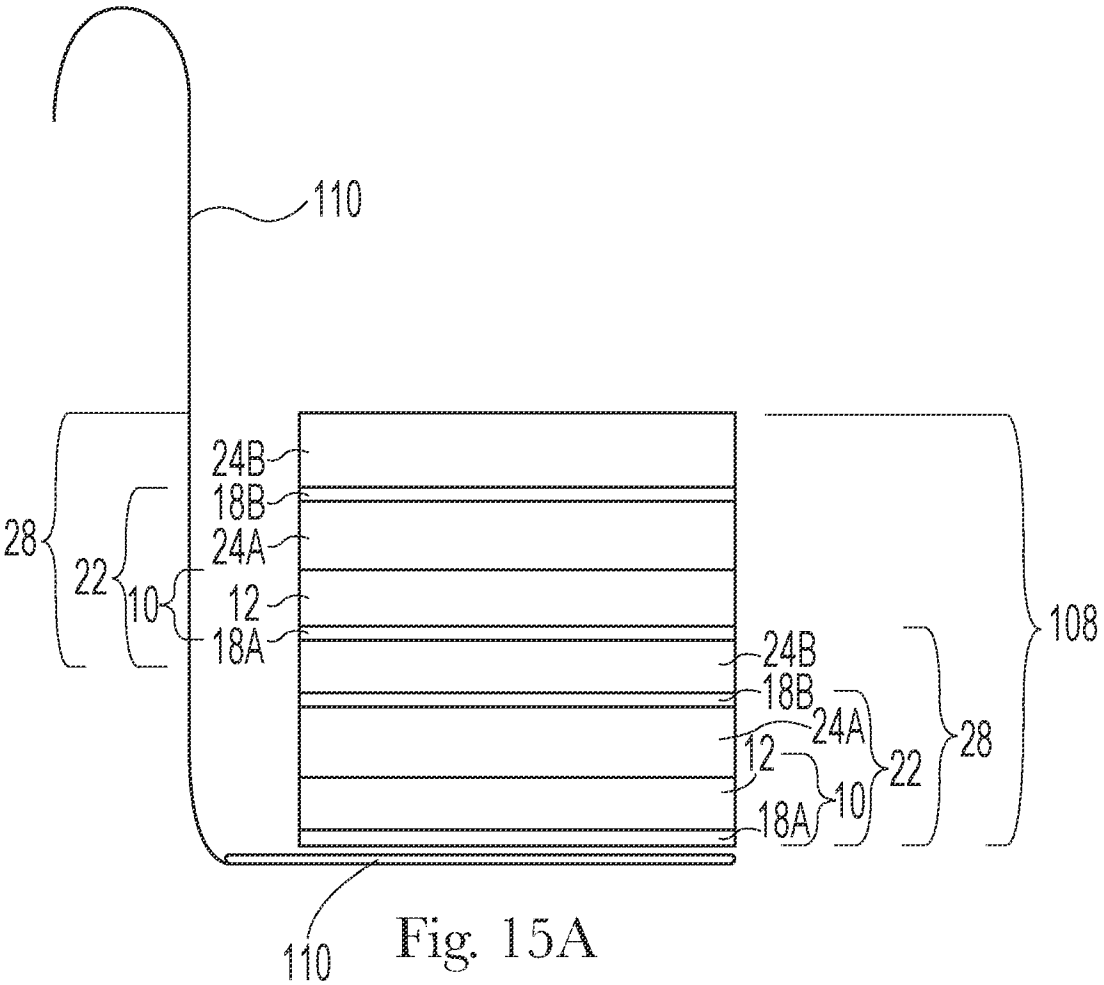
FIG. 15A is a schematic representation of a dry sample holder and pad according to the Pad Sink Test Method.
Figure 15B:
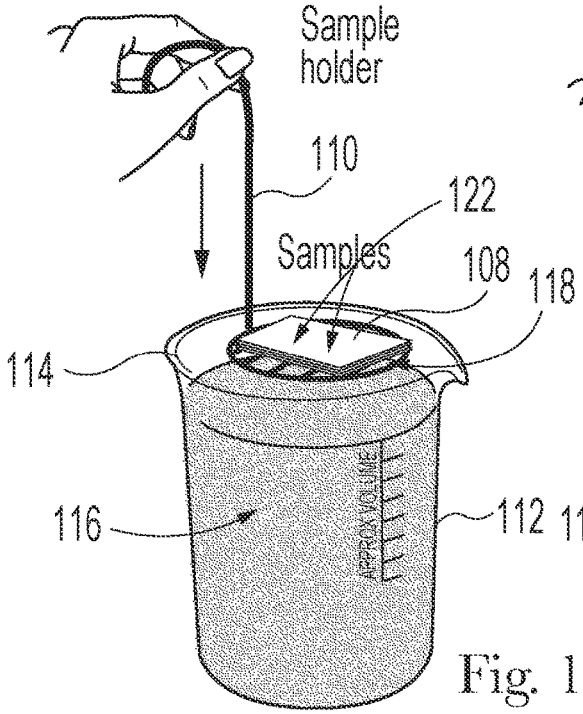
FIG. 15B is a schematic representation of an initial set-up for the Pad Sink Test Method.
Figure 15C:
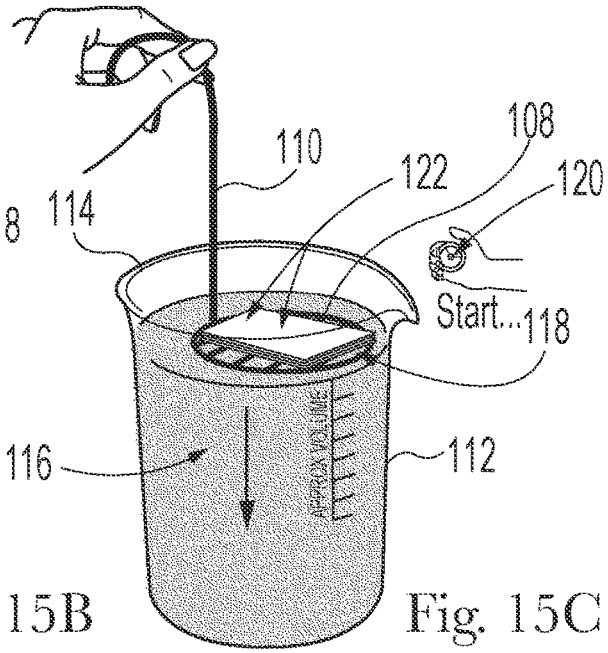
FIG. 15C is a schematic representation of the start of the actual Pad Sink Test Method.
Figure 15D:
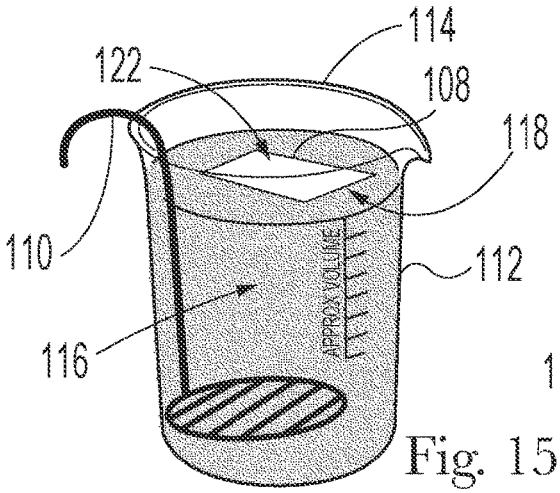
FIG. 15D is a schematic representation of a point in time after the start of the Pad Sink Test Method.
Figure 15E:
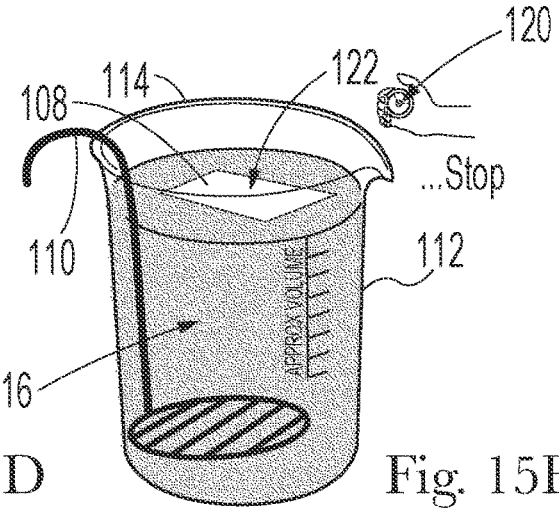
FIG. 15E is a schematic representation of the end of the Pad Sink Test Method.

To prepare a finished fibrous structure (product) to be tested, remove any wrapping around the product and discard the first 10 usable units from the beginning of the product, for example if the product is in roll form, such as a paper towel roll (a dry paper towel roll such as less than 5% by weight of water (moisture)), which has multiple usable units that are connected to one another via perforation lines, then remove the first 10 usable units from the beginning of the roll and discard them, then select the next 8 usable units for this test if they have no defects. If there are defects in any of the 8 usable units, then discard the defective usable units and replace with defect-free usable units. Stack the 8 usable units in 4 stacks of 2 usable units thick with the more hydrophobic side of each usable unit facing downward, for example the side that contains the core component 12 of the coform fibrous structure 10 as shown in FIG. 15A. Be sure to sample the undecorated portion of the product if at all possible. Condition the stacks of usable units for at least 10 minutes in the conditioned room before proceeding with the sample preparation and testing.

If any of the usable units contain a surface hydrophilic modifier remove the surface hydrophilic modifier or remake the usable units without any surface hydrophilic modifier being present.

Using an Alfa Precision Sample Cutter Model 240-10 (hydraulic) or Model 240-7A (pneumatic) available from Thwing-Albert Instrument Co. of Berlin, NJ. and a 63.5 mm×76.2 mm cutting die available from Acme Steel Rule Die Corp. of Waterbury, CT or equivalent modified with a 6.4 mm thick polyurethane foam insert available from Crofton, Inc. of Marion, IN or equivalent are used to cut two pads 63.5 mm MD×76.2 mm CD from two separate stacks of usable units formed above. Then test immediately as described below.

As shown in FIGS. 15A-15D, a pad 108 (2 usable units thick) is placed on a dry sample holder 110 and gently and slowly lowered into a 3000 mL beaker 112 made of stainless steel, Pyrex glass, polymethylpentene transparent, chemical resistant plastic, or equivalent is filled to within 25 mm±5 mm of the top 114 of the beaker 112 with distilled water 116 that has been conditioned in the conditioned room for at least 24 hours making sure to keep the bottom surface 118 of the pad 108 parallel to the surface of the distilled water 116. A timer 120, for example a stop watch or digital timer, is started at the instant the bottom surface 118 of the pad 108 contacts the surface of the distilled water 116. Allow the sample holder 110 to continue downward into the beaker 112 after the pad 108 floats on the surface of the distilled water 116 so that the handle of the sample holder 110 catches on the top 114 of the beaker 112.

Observe the pad 108 and stop the timer 120 at the instant the top surface 122 of the pad 108 becomes completely wet (no dry spots remaining) from the distilled water 116. Record the time to the nearest 0.1 of a second.

Remove the pad 108 from the beaker 112 with the sample holder 110 by raising the sample holder 110 out of the beaker 112. Discard the tested pad 108 and dry the sample holder 110 and test the second pad 108 following the same procedure.

Average the results of both pads tested and report to the nearest 0.1 seconds.

Phink Test Method

This Phink Test Method is used to determine rate of water absorption of a composite fibrous structure as described herein.

The test is conducted in a conditioned room with a temperature of 23° C.±1° C. and a relative humidity of 50%±2%.

Phink Times for a composite fibrous structure are measured on three stacks of ten samples thick. A precision cutting die, measuring 100 mm by 100 mm is used to cut the samples from a unwoven roll of composite fibrous structure immediately after producing the composite fibrous structure.

Figure 16:
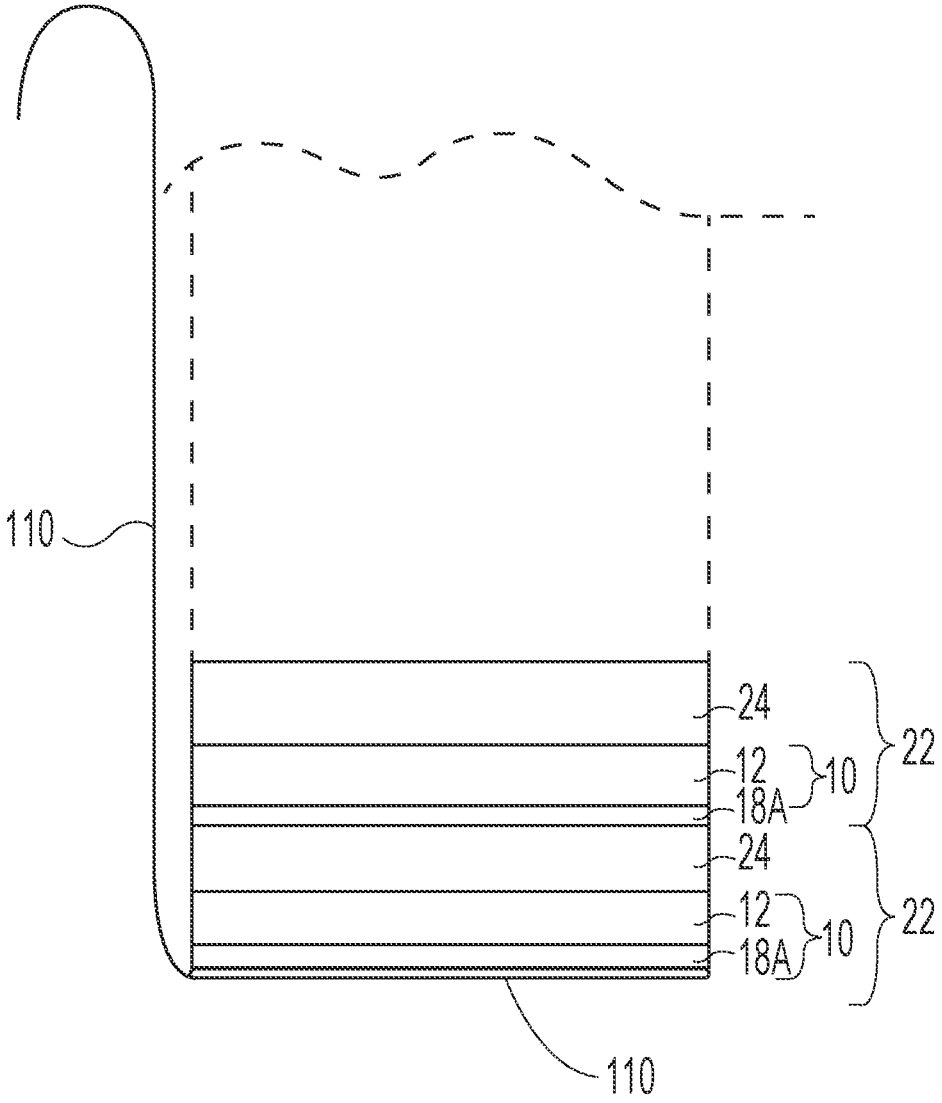
FIG. 16 is a schematic representation of a dry sample holder and pad according to the Phink Test Method.

Condition the samples for a minimum of 10 minutes prior to testing. Combine the cut samples to form a stack ten samples thick with the more hydrophobic side of each sample facing downward, for example the side that contains the core component 12 of the coform fibrous structure 10 as shown in FIG. 16. Repeat until a total of three stacks of ten samples thick have been prepared.

If the composite fibrous structure contains a surface hydrophilic modifier remove the surface hydrophilic modifier or remake the composite fibrous structure without any surface hydrophilic modifier being present.

As generally shown and described in FIGS. 10B-10E above, a pad 108 (10 samples thick rather than 2 usable units thick as described in the Pad Sink Test Method above) is placed on a dry sample holder 110, as partially shown in FIG. 16 (only 2 samples are shown in FIG. 16, but a total of 10 samples would make up the pad for testing under this Phink Test Method) and gently and slowly lowered into a 3000 mL beaker 112 made of stainless steel, Pyrex glass, polymethylpentene transparent, chemical resistant plastic, or equivalent is filled to within 25 mm±5 mm of the top 114 of the beaker 112 with distilled water 116 that has been conditioned in the conditioned room for at least 24 hours making sure to keep the bottom surface 118 of the pad 108 parallel to the surface of the distilled water 116. A timer 120, for example a stop watch or digital timer, is started at the instant the bottom surface 118 of the pad 108 contacts the surface of the distilled water 116. Allow the sample holder 110 to continue downward into the beaker 112 after the pad 108 floats on the surface of the distilled water 116 so that the handle of the sample holder 110 catches on the top 114 of the beaker 112.

Observe the pad 108 and stop the timer 120 at the instant the top surface 122 of the pad 108 becomes completely wet (no dry spots remaining) from the distilled water 116. Record the time to the nearest 0.1 of a second.

Remove the pad 108 from the beaker 112 with the sample holder 110 by raising the sample holder 110 out of the beaker 112. Discard the tested pad 108 and dry the sample holder 110 and test the second and third pads 108 following the same procedure.

Average the results of the three pads tested and report to the nearest 0.1 seconds.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A paper towel comprising a coform fibrous structure, wherein the coform fibrous structure comprises a plurality of solid additives and a plurality of fibrous elements, wherein at least one of the fibrous elements comprises a polymer composition comprising a polymer comprising a polymer chain disrupter and a hydrophilic modifier, such that the paper towel exhibits a Pad Sink Time of greater than 0 seconds to less than 6.0 seconds within less than 30 days after production of the paper towel as measured according to the Pad Sink Test Method, wherein the coform fibrous structure further comprises at least one scrim material; and a second fibrous structure ply.

2. The paper towel according to claim 1 wherein the plurality of fibrous elements comprises a plurality of filaments.

3. The paper towel according to claim 1 wherein the polymer chain disrupter comprises a copolymer.

4. The paper towel according to claim 1 wherein the at least one scrim material is substantially void of scrim solid additives.

5. The paper towel according to claim 1 wherein the paper towel further comprises a wet-laid fibrous structure.

6. The paper towel according to claim 5 wherein the wet-laid fibrous structure comprises a plurality of fibers.

7. The paper towel according to claim 6 wherein at least one of the fibers comprises a pulp fiber.

8. The paper towel according to claim 7 wherein the pulp fiber comprises a wood pulp fiber.

9. The paper towel according to claim 8 wherein the wood pulp fiber is selected from the group consisting of: hardwood pulp fibers, softwood pulp fibers, and mixtures thereof.

10. The paper towel according to claim 5 wherein the wet-laid fibrous structure comprises an absorbent gel material.

11. The paper towel according to claim 5 wherein the wet-laid fibrous structure comprises a surface having a surface pattern.

12. The paper towel according to claim 11 wherein the surface pattern comprises one or more relatively high density regions and one or more relatively low density regions.

13. The paper towel according to claim 5 wherein a surface of the wet-laid fibrous structure is adjacent to a surface of the coform fibrous structure.

14. The paper towel according to claim 5 wherein the wet-laid fibrous structure comprises at least one scrim material that forms an exterior surface of the paper towel.

15. The paper towel according to claim 5 wherein the paper towel further comprises a second wet-laid fibrous structure.

16. The paper towel according to claim 15 wherein the second wet-laid fibrous structure comprises a surface having a surface pattern.

17. The paper towel according to claim 16 wherein the surface pattern comprises one or more relatively high density regions and one or more relatively low density regions.

18. The paper towel according to claim 1 wherein the paper towel is in the form of a roll.

* * * * *